US010413149B2

(12) United States Patent
Johnson

(10) Patent No.: US 10,413,149 B2
(45) Date of Patent: Sep. 17, 2019

(54) SURFACE CLEANING APPARATUS

(71) Applicant: BISSELL Homecare, Inc., Grand Rapids, MI (US)

(72) Inventor: Steve M. Johnson, Hudsonville, MI (US)

(73) Assignee: BISSELL HOMECARE, Inc., Grand Rapids, MI (US)

( * ) Notice: Subject to any disclaimer, the term of this patent is extended or adjusted under 35 U.S.C. 154(b) by 0 days.

(21) Appl. No.: 15/899,153

(22) Filed: Feb. 19, 2018

(65) Prior Publication Data

US 2018/0168421 A1 Jun. 21, 2018

Related U.S. Application Data

(63) Continuation of application No. 15/373,644, filed on Dec. 9, 2016, now Pat. No. 9,931,014, which is a continuation of application No. 14/589,125, filed on Jan. 5, 2015, now Pat. No. 9,521,940, which is a continuation of application No. 13/410,580, filed on Mar. 2, 2012, now Pat. No. 8,926,208.

(60) Provisional application No. 61/449,351, filed on Mar. 4, 2011.

(51) Int. Cl.

| | |
|---|---|
| ***A47L 13/00*** | (2006.01) |
| ***A47L 13/22*** | (2006.01) |
| ***A47L 11/40*** | (2006.01) |

(52) U.S. Cl.

CPC ..... *A47L 13/225* (2013.01); *A47L 11/4002* (2013.01); *A47L 11/4036* (2013.01); *A47L 11/4075* (2013.01); *A47L 11/4086* (2013.01); *A47L 13/22* (2013.01)

(58) Field of Classification Search

CPC ..... A47L 13/22; A47L 13/225

See application file for complete search history.

(56) References Cited

U.S. PATENT DOCUMENTS

| | | | |
|---|---|---|---|
| 3,115,656 | A | 12/1963 | McKinstry |
| 3,748,050 | A | 7/1973 | Poppitz |
| 4,114,223 | A | 9/1978 | Buchanan |
| 4,119,386 | A | 10/1978 | Cushing |
| 5,455,980 | A | 10/1995 | Buchanan |
| 5,735,620 | A | 4/1998 | Ford |

(Continued)

FOREIGN PATENT DOCUMENTS

| | | | |
|---|---|---|---|
| CN | 2197943 | Y | 5/1995 |
| CN | 2356632 | Y | 1/2000 |

(Continued)

OTHER PUBLICATIONS

Bissell, Steam Mop User's Guide 1967 Series, pp. 1-12, www.bissell.com Grand Rapids, Michigan 2002.

(Continued)

*Primary Examiner* — Jennifer C Chiang

(74) *Attorney, Agent, or Firm* — McGarry Bair PC

(57) ABSTRACT

A surface cleaning apparatus, such as a fluid delivery or steam mop, comprises a handle assembly comprising a steam distributor and a foot assembly pivotally attached to the handle assembly and comprising a base housing. The foot assembly can be used in two positions, whereby opposing sides of a cleaning pad on the base housing can selectively engage a surface to be cleaned. The foot assembly is further swivelable relative to the steam distributor, such that fluid can be delivered to the surface to be cleaned in both of the two use positions.

20 Claims, 20 Drawing Sheets

(56) References Cited

U.S. PATENT DOCUMENTS

| | | | |
|---|---|---|---|
| 6,588,045 | B2 | 7/2003 | Fernandez |
| 6,644,877 | B1 | 11/2003 | Chen |
| 6,684,446 | B2 | 2/2004 | Salmon |
| 7,600,401 | B2 | 10/2009 | Rosenzweig |
| 7,669,280 | B2 | 3/2010 | Rosenzweig |
| 7,735,182 | B2 | 6/2010 | Morris et al. |
| 7,996,948 | B2 | 8/2011 | Kaminer et al. |
| 8,052,342 | B2 | 11/2011 | Rosenzweig et al. |
| 8,425,137 | B1 | 4/2013 | Sampaio |
| 8,458,850 | B2 | 6/2013 | Kasper et al. |
| 9,125,540 | B2 | 9/2015 | Tran et al. |
| 2004/0146332 | A1 | 7/2004 | Fu |
| 2005/0091775 | A1 | 5/2005 | Lindholm |
| 2006/0000049 | A1 | 1/2006 | Rosenzweig |
| 2006/0053581 | A1 | 3/2006 | McCully |
| 2006/0168755 | A1 | 8/2006 | Langerak |
| 2008/0066789 | A1 | 3/2008 | Rosenzweig et al. |
| 2008/0236635 | A1 | 10/2008 | Rosenzweig et al. |
| 2009/0320231 | A1 | 12/2009 | Rosenzweig et al. |
| 2010/0107351 | A1 | 5/2010 | Rosenzweig et al. |
| 2010/0126533 | A1 | 5/2010 | Nottingham et al. |
| 2010/0269282 | A1 | 10/2010 | Kaminer et al. |
| 2010/0272948 | A1 | 10/2010 | Kaminer et al. |
| 2011/0240068 | A1 | 10/2011 | Rosenzweig et al. |
| 2014/0076368 | A1 | 3/2014 | Hansen et al. |

FOREIGN PATENT DOCUMENTS

| | | | |
|---|---|---|---|
| CN | 2482956 | Y | 3/2002 |
| CN | 2549888 | Y | 5/2003 |
| CN | 2756150 | Y | 2/2006 |
| CN | 2879946 | Y | 3/2007 |
| CN | 2894596 | Y | 5/2007 |
| CN | 201019688 | Y | 2/2008 |
| CN | 201052128 | Y | 4/2008 |
| CN | 201208239 | Y | 3/2009 |
| DE | 9415002 | | 11/1994 |
| GB | 281538 | | 12/1927 |
| GB | 2294196 | A | 4/1996 |
| GB | 2450730 | A | 7/2009 |
| JP | 9164110 | A | 6/1997 |
| JP | 2009034158 | A | 2/2009 |
| KR | 2019930021019 | | 10/1993 |
| KR | 200288566 | Y | 1/2003 |
| WO | 200032083 | A2 | 6/2000 |
| WO | 2005023079 | A2 | 3/2005 |
| WO | 2006028807 | A2 | 3/2006 |
| WO | 2008016761 | A2 | 2/2008 |
| WO | 2008096949 | A1 | 8/2008 |
| WO | 2008096950 | A1 | 8/2008 |

OTHER PUBLICATIONS

Bissell, Steam Mop User's Guide 1967 Series, pp. 1-12, www.bissell.com Grand Rapids, Michigan 2007.

SURFACE CLEANING APPARATUS

CROSS REFERENCE TO RELATED APPLICATION(S)

This application is a continuation of U.S. patent application Ser. No. 15/373,644, filed Dec. 9, 2016, now U.S. Pat. No. 9,931,014, issued Apr. 3, 2018, which is a continuation of U.S. patent application Ser. No. 14/589,125, filed Jan. 5, 2015, now U.S. Pat. No. 9,521,940, issued Dec. 20, 2016, which is a continuation of U.S. patent application Ser. No. 13/410,580, filed Mar. 2, 2012, now U.S. Pat. No. 8,926,208, issued Jan. 6, 2015, which claims the benefit of U.S. Provisional Patent Application No. 61/449,351, filed Mar. 4, 2011, all of which are incorporated herein by reference in their entirety.

BACKGROUND OF THE INVENTION

Surface cleaning apparatus with steam delivery, such as steam mops, are well known devices for cleaning floor surfaces, such as tile, linoleum, vinyl, laminate, and hardwood floors. Typical steam mops have a reservoir for storing water that is fluidly connected to a selectively engageable pump or valve. The pump or valve outlet is fluidly connected to a steam boiler with a heating element to heat the water. The steam boiler generates steam, which is directed towards the cleaning surface through a nozzle or manifold mounted in a foot assembly that engages the floor surface. Steam is typically applied to the backside of a cleaning pad attached to the foot assembly. Steam vapor eventually saturates the entire cleaning pad as the moisture wicks outwardly from the point of steam application. The damp pad is wiped across the floor surface to remove dirt, dust, and debris present on the floor surface.

During use, the cleaning pad eventually becomes saturated with liquid and soiled with embedded dirt, dust, and debris. The soiled mop pad can be disposed of, or laundered and re-used. A cleaning pad can generally be used for one or two steam mopping sessions prior to being laundered.

BRIEF SUMMARY OF THE INVENTION

According to one aspect of the invention, a surface cleaning apparatus includes a foot assembly adapted to move across a surface to be cleaned and comprising a base housing, a handle assembly pivotally attached to the foot assembly and comprising a steam distributor and steam generator in fluid communication with the steam distributor, a cleaning pad on the base housing and having opposed first and second cleaning surfaces, and a coupling joint pivotally attaching the foot assembly to the handle assembly and defining a first axis of rotation, wherein the foot assembly is swivelable relative to the handle assembly about the first axis of rotation between a first use position in which the first cleaning surface of the cleaning pad faces the surface to be cleaned, and a second use position in which the second cleaning surface of the cleaning pad faces the surface to be cleaned, wherein the foot assembly is further swivelable relative to the steam distributor about the first axis.

DESCRIPTION OF EMBODIMENT(S) OF THE INVENTION

The invention relates to a surface cleaning apparatus having a foot assembly that rests on a floor surface, and a handle assembly pivotally attached to the foot assembly. More specifically, the invention relates to a surface cleaning apparatus in which the foot assembly is biased with respect to the handle assembly.

Figure 1:
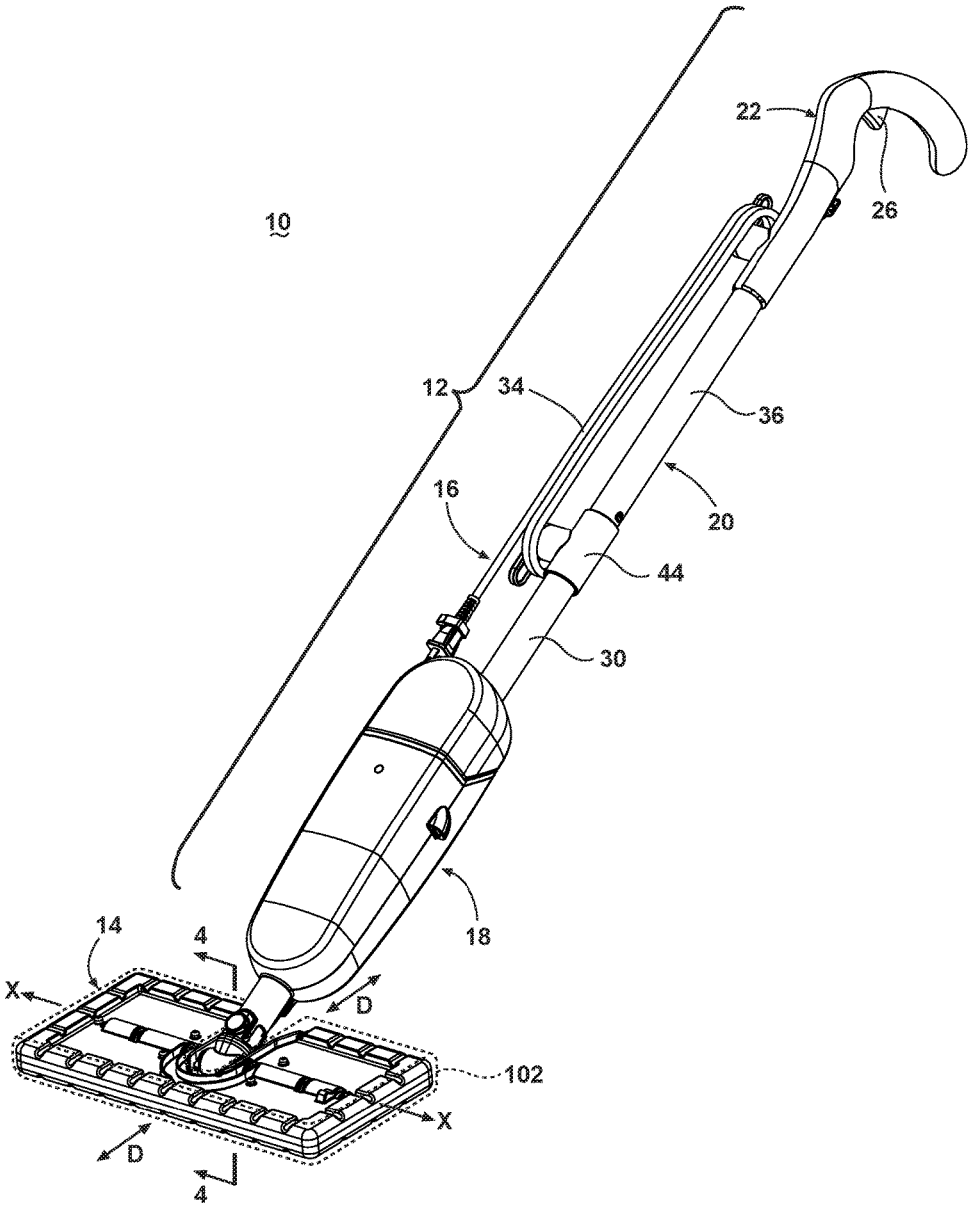
FIG. 1 is a front perspective view of a surface cleaning apparatus in the form of a steam mop comprising an upright handle assembly and a foot assembly according to a first embodiment of the invention.

Referring to the drawings, and in particular to FIG. 1, a steam mop 10 according to a first embodiment of the invention comprises a housing with an upright handle assembly 12 and a base or foot assembly 14 pivotally mounted to the handle assembly 12. The handle assembly 12 can pivot from an upright or stored position, in which the handle assembly 12 is substantially vertical relative to a surface to be cleaned, to a lowered or use position, shown in FIG. 1, in which the handle assembly 12 is rotated in a rearward direction relative to the foot assembly 14 to an acute angle relative to the surface to be cleaned. As shown herein, the steam mop 10 is adapted to glide across the surface to be cleaned on the foot assembly 14 and the handle assembly 12 is configured to direct the foot assembly 14 across the surface to be cleaned. Alternatively, the steam mop 10 can comprise wheels or rollers to facilitate movement across the surface to be cleaned. The steam mop 10 can be used for cleaning hard floor surfaces, such as tile, linoleum, and wood, or soft floor surfaces, such as carpets and rugs. In use, the foot assembly 14 is typically moved in a back-and-forth manner across the surface to be cleaned along a direction of travel D, although other movement patterns are possible.

The handle assembly 12 comprises an upper handle portion 16 and a lower body portion 18. The upper handle portion 16 comprises a hollow handle tube assembly 20 having a grip assembly 22 fixedly attached to a first end of the handle tube assembly 20 and the body portion 18 fixedly attached to a second end of the handle tube assembly 20 via screws or other suitable commonly known fasteners. The grip 22 assembly is engageable by a user for manipulating the steam mop 10. As shown herein, the grip assembly 22 has an arcuate shape; however, the grip assembly 22 can be formed in other shapes commonly found on surface cleaning apparatus, such as closed-loop grips having circular or triangular shapes.

Figure 2:
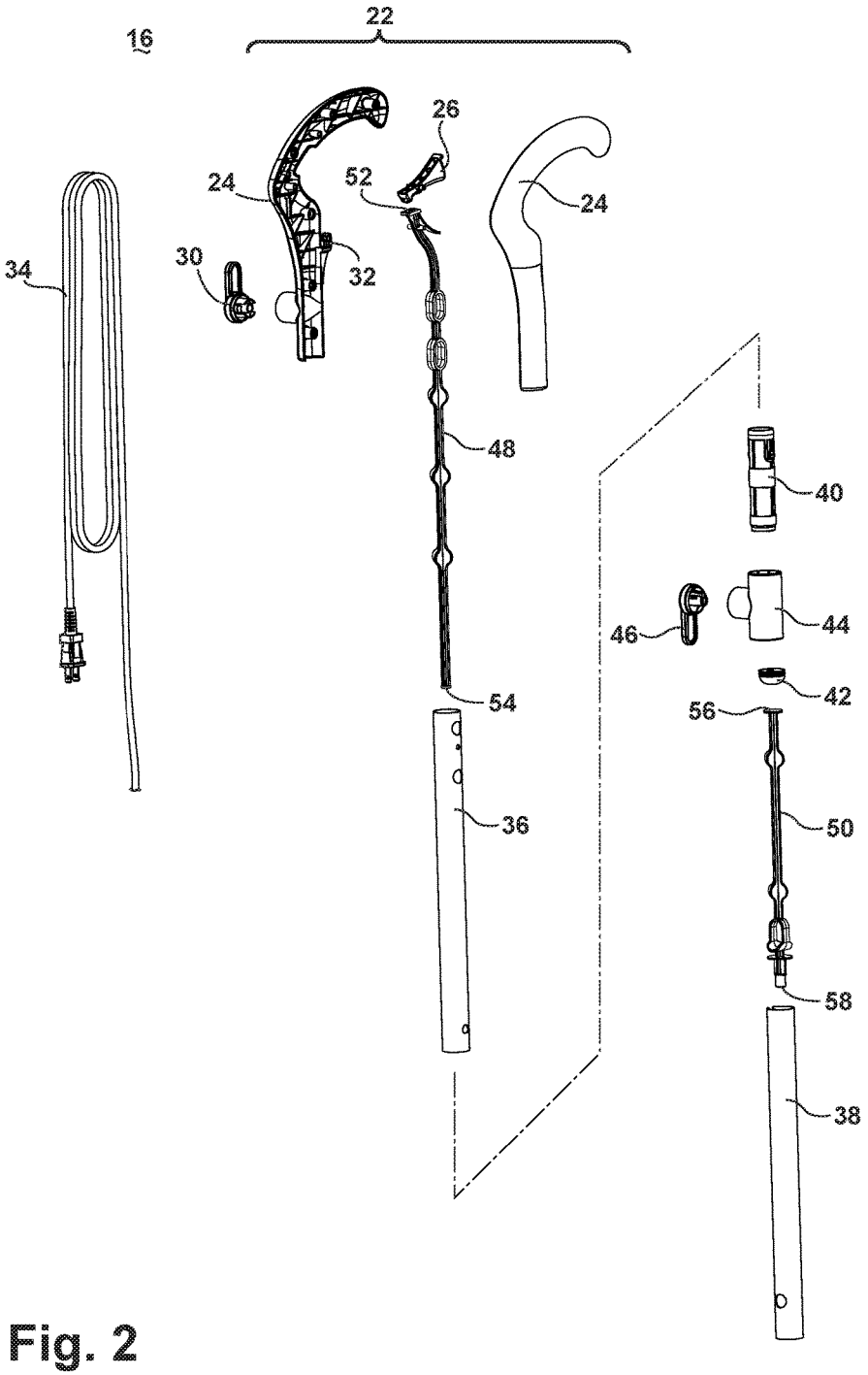
FIG. 2 is an exploded view of an upper handle portion of the handle assembly from FIG. 1.

FIG. 2 is an exploded view of the upper handle portion 16 of the handle assembly 12. The grip assembly 22 is formed by two mating arcuate grip halves 24 that form a recess to receive a pivotally mounted trigger 26, with a portion of the trigger 26 projecting outwardly from the grip assembly 22 where it is accessible to the user.

The grip assembly 22 further comprises an upper cord wrap 30, and a cord lock 32. The cord wrap 30 is adapted to support an electrical cord 34 when not in use, and the cord lock 32 is adapted to retain one loop of the electrical cord 34 near the top of the handle assembly 12 during use, thus keeping the electrical cord 34 out of the path of the steam mop 10. A power switch (not shown) can be provided on the steam mop 10, and operably connects line electrical power to the steam mop 10 via the electrical cord 34, thereby permitting a user to selectively energize the steam mop 10.

The handle tube 20 comprises an upper tube 36 and a lower tube 38 which are coupled together by a tube bushing 40. The tube bushing 40 comprises a bushing seal 42 at a lower end thereof. A connector tube 44 surrounds the upper and lower tubes 36, 38, overlapping the coupled ends of the upper and lower tubes 36, 38. The connector tube 44 further comprises a lower cord wrap 46 which, together with the upper cord wrap 30, supports the electrical cord 34 when not in use.

The trigger 26 is operably coupled with an upper push rod 48 that is primarily positioned within the hollow interior of the upper tube 36 and a lower push rod 50 that is primarily positioned within the hollow interior of the lower tube 38. The upper push rod 48 has an upper end 52 that is slidably mounted within the grip assembly 22 and a lower end 54 that extends through the tube bushing 40 and selectively engages the bushing seal 42. The lower push rod 50 has an upper end 56 adjacent the bushing seal 42 and a lower end 58 that selectively engages a micro-switch (not shown) that is operably connected to a steam delivery system mounted within the lower body portion 18.

The trigger 26 is positioned to engage the upper end 52 of the upper push rod 48 when squeezed, forcing the upper push rod 48 to slide downwardly within the upper tube 36. The lower end 54 of the upper push rod 48 elastically deforms the bushing seal 42 and engages the upper end 56 of the lower push rod 50 through the bushing seal 42. The lower push rod 50 slides downwardly within the lower tube 38, and the lower end 58 engages the micro-switch (not shown).

Figure 3:
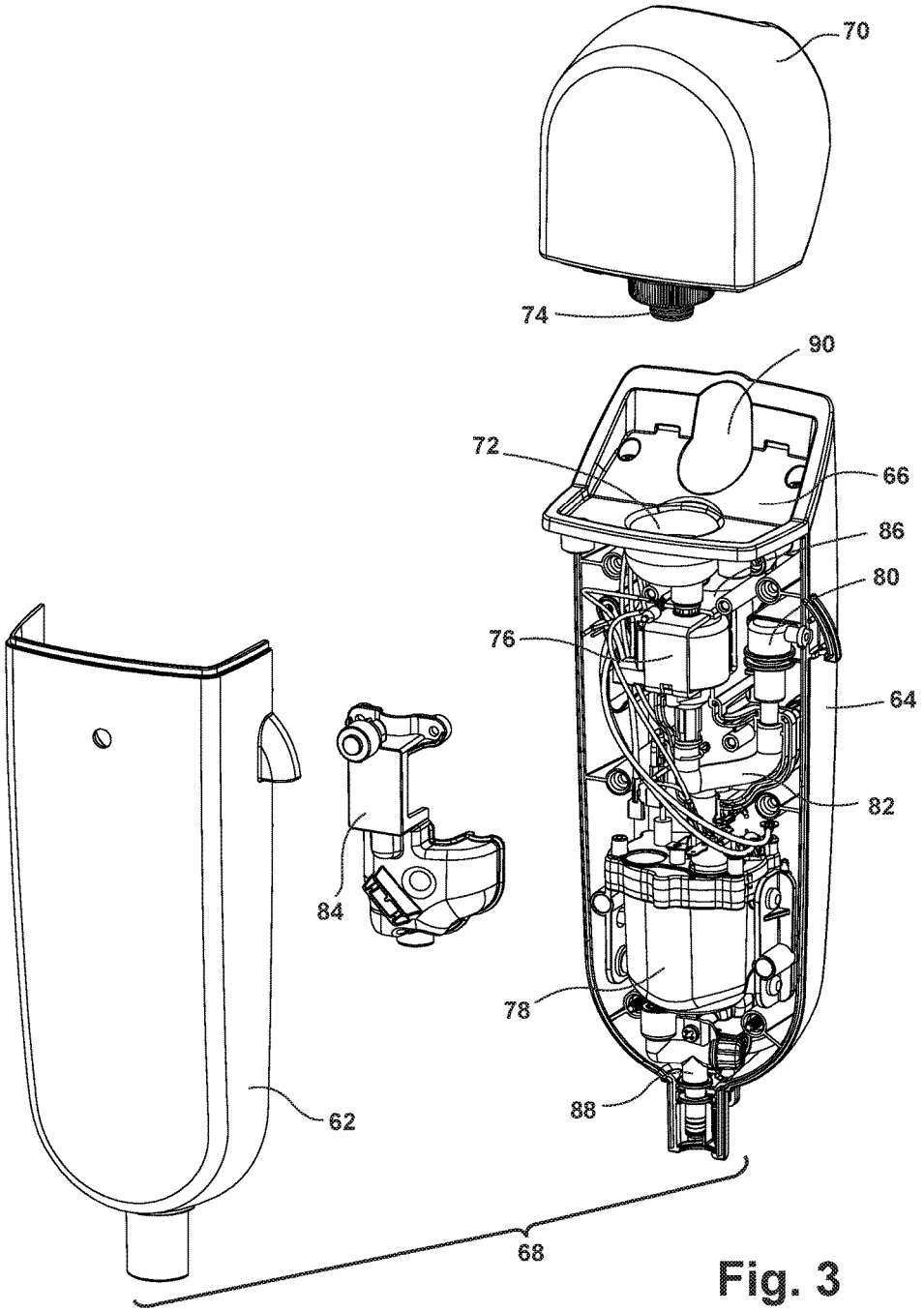
FIG. 3 is a partially exploded view of a lower body portion of the handle assembly from FIG. 1.

FIG. 3 is a partially exploded view of the lower body portion 18 of the handle assembly 12. The lower body portion 18 comprises elongated, mating front and rear enclosures 62, 64 that form a central cavity (not shown) therebetween for mounting components of the steam mop 10, such as a portion of a steam delivery system of the steam mop 10. A top enclosure 66 mates with the front and rear enclosures 62, 66 to enclose the central cavity. In FIG. 3, the front enclosure 62 is shown exploded from the rear and top enclosures 64, 66. The front and rear enclosures 62, 66 each comprise an extension at a lower portion thereof which mate together to form a handle extension 68 for coupling with the foot assembly 14, as is described below.

The steam delivery system comprises a fluid distribution system for storing a cleaning fluid, heating the fluid to generate steam, and a steam distributor for delivering the steam to the cleaning surface. The fluid distribution system comprises a fluid supply tank 70 adapted for fluid connection to a receiver 72 on the top enclosure 66. The fluid supply tank 70 is at least partially supported by the top enclosure 66 when mounted to the steam mop 10. In FIG. 3, the fluid supply tank 70 is shown exploded from the top enclosure 66. The fluid supply tank 70 is configured to hold a predetermined amount of liquid and comprises a tank outlet assembly 74 which mates with the receiver 72 and which can selectively be removed to fill the tank 70. In one embodiment, the liquid is water or electrolyzed water. Optionally, a variety of cleaning chemicals, fragrances, botanical oils, and the like can be mixed with water to form the liquid. In an alternate embodiment not shown herein, an optional filter module can be detachably connected to the fluid supply tank 70 for removing impurities within the cleaning fluid.

A pump 76, steam generator 78, and a pressure relief valve 80 are mounted within the central cavity and fluidly connected via conventional tubing and fluid fittings therebetween. As shown in FIG. 3, an inlet of the pump 76 is coupled with the tank receiver 72 and an outlet of the pump 76 is coupled with the steam generator 78 via one branch of a T-shaped connection tube 82. Another branch of the T-shaped connection tube 82 couples the outlet of the pump 76 with the pressure relief valve 80.

The pump 76 is mounted between a front pump cover 84 and a rear tube cover 86. The tube cover 86 attaches to the rear enclosure 64, and, when assembled with the upper handle portion 16 (FIG. 2), encloses a portion of the lower tube 38 and lower push rod 50 therebetween, which extend downwardly through a handle receiver 90 in the top enclosure. The tube cover 86 further encloses the micro-switch. The pump 76 is selectively electrically coupled with the electrical cord 34 via the micro-switch (not shown) that is operably connected to the trigger 26 mounted in the grip 22 portion. The pump 76 can comprise a conventional solenoid pump. Alternatively, the pump 76 can be replaced by a valve (not shown) to permit liquid to flow from the fluid supply tank 70 into the steam generator 78 and, subsequently, onto the cleaning surface.

The steam generator 78 comprises a heating element for heating liquid that passes into the steam generator 78 from the pump 76. For example, the steam generator 78 can be a flash steam heater or a boiler for generating steam. A steam port 88 is coupled to an outlet of the steam generator 78 and at least partially extends through the handle extension 68 for delivery of steam to the foot assembly 14, as described below. The steam generator 78 is electrically coupled with the electrical cord 34 and can be selectively energized by plugging the cord 34 into a power outlet. As previously described, the pump 76 is selectively electrically coupled with the electrical cord 34 via the micro-switch (not shown) that is operably connected to the trigger 26 mounted in the grip 22 portion. Thus upon energizing the steam generator 78, the pump 76 can be selectively activated to distribute steam when the user depresses the trigger 26 (FIG. 1).

Figure 4:
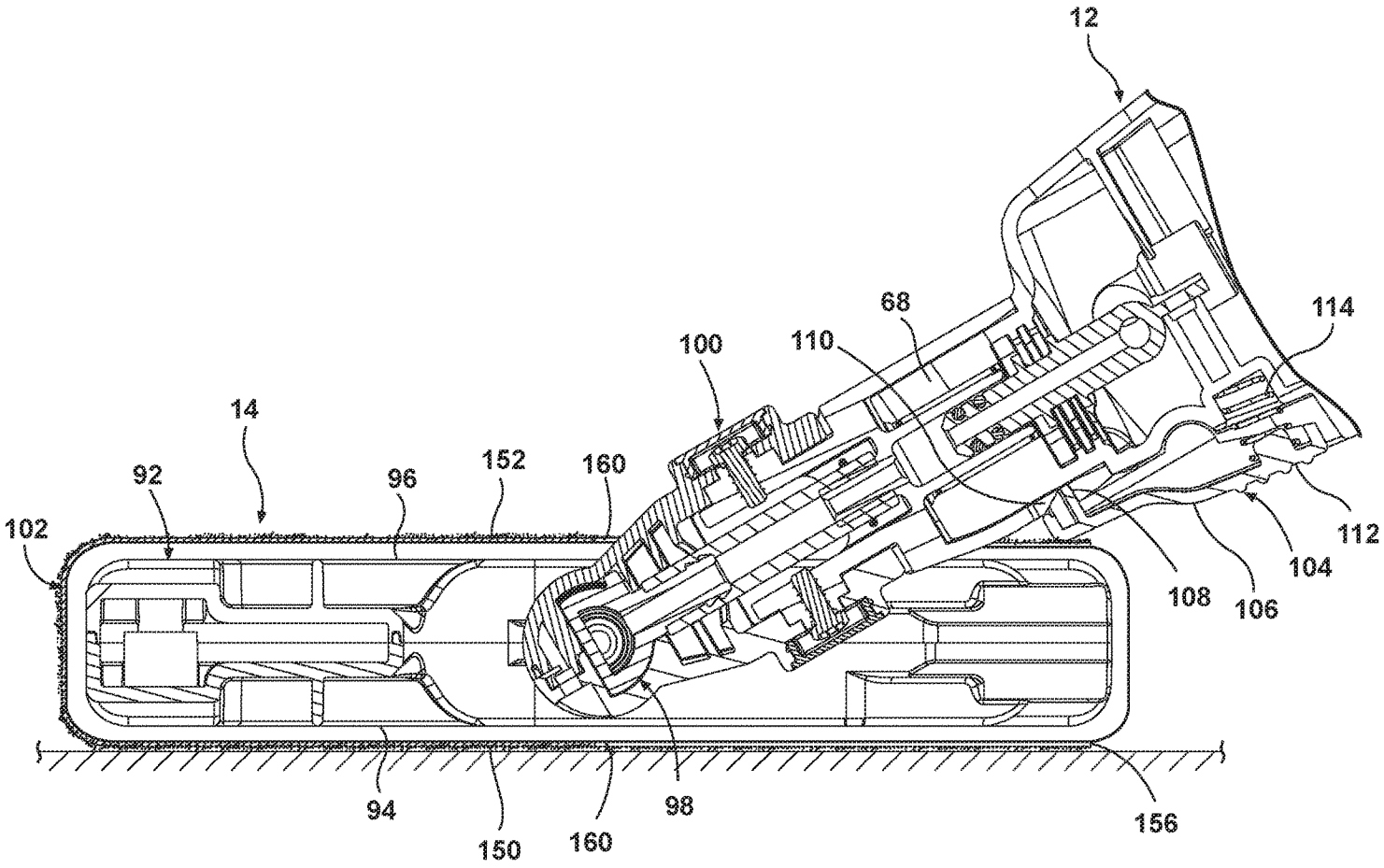
FIG. 4 is a cross-sectional view of the foot assembly taken along line 4-4 of FIG. 1.

FIG. 4 is a cross-sectional view of the foot assembly 14 taken along line 4-4 of FIG. 1. The foot assembly 14 comprises base housing 92 having mating first and second enclosures 94, 96, respectively that form a central cavity therebetween for mounting components of the steam mop 10, such as a steam distributor 98 of the steam delivery system. The first and second enclosures 94, 96 can be secured together with mechanical fasteners (not shown). The base housing 92 is swivelably mounted to the handle assembly 12 via a coupling joint 100 which receives the handle extension 68. A cleaning pad 102 can be selectively received on the base housing 92.

A latch assembly 104 can be provided for selective detachment of the foot assembly 14 from the handle assembly 12. As shown herein, the latch assembly 104 comprises a latch 106 that is pivotally mounted to a lower portion of the handle assembly 12 and includes a locking protrusion 108 at one end thereof which is selectively received by within a locking slot 110 provided on the coupling joint 100. An opposite end of the latch 106 comprises a user-engageable portion 112 that is biased on the locked position shown in FIG. 4 by a spring 114. Pressing the user-engageable portion 112 causes the latch 106 to pivot such that the locking protrusion 108 is withdrawn from the locking slot 110, thereby allowing the handle extension 68 to be withdrawn from the coupling joint 100, which effectively detaches the foot assembly 14 from the handle assembly 12.

Figure 5:
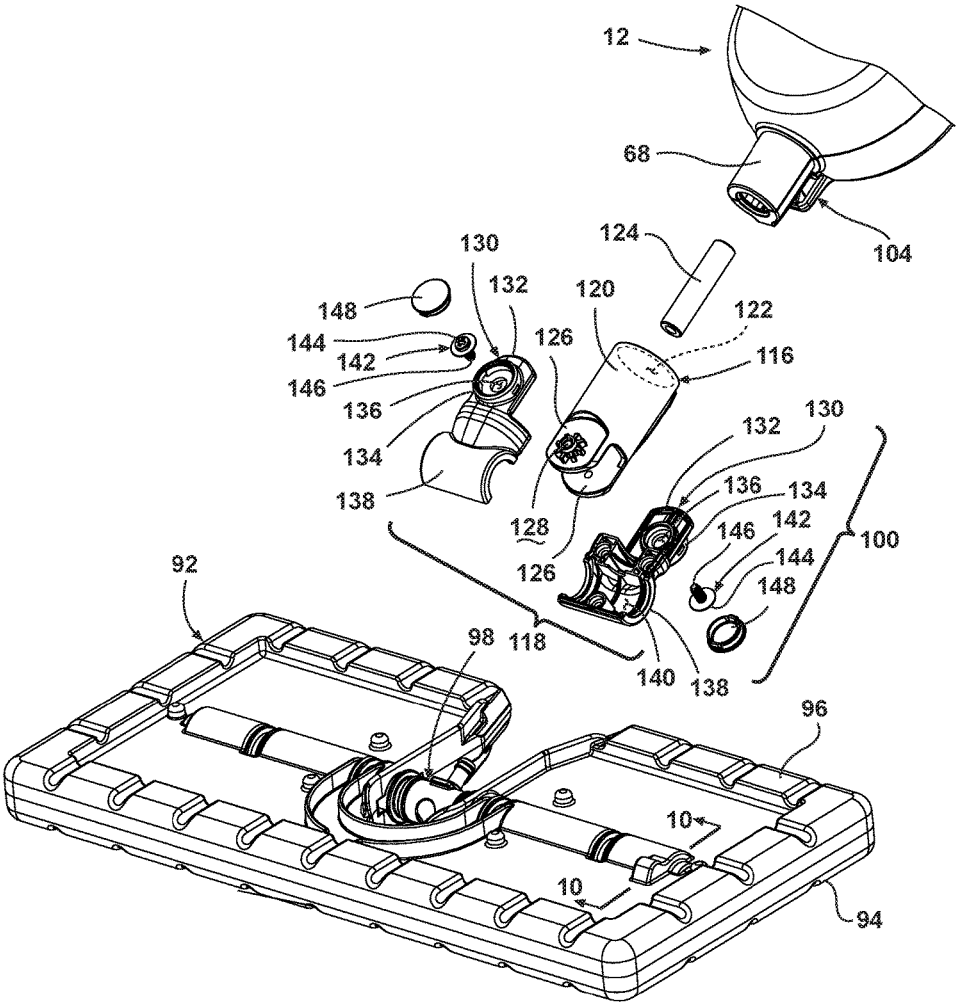
FIG. 5 is a partially exploded view of the foot assembly from FIG. 4.

FIG. 5 is a partially exploded view of the foot assembly 14, illustrating the coupling joint 100. As shown herein, the coupling joint 100 can comprise a universal or Cardan joint, and can be configured to permit the foot assembly 14 to swivel multi-axially relative to the handle assembly 12. Alternatively, the coupling joint 100 can be configured to at least permit the foot assembly 14 to swivel about an axis X (shown in FIG. 1) relative to the handle assembly 12, where the axis X is generally perpendicular to the axis defining the direction of travel D of the steam mop 10.

The coupling joint 100 comprises a handle connector 116 which pivotally couples with a foot connector 118 and defines a first axis of rotation about which the foot assembly 14 can rotate with respect to the handle assembly 12. The foot connector 118 in turn pivotally couples with the base housing 92 and defines a second axis of rotation about which the foot assembly 14 can rotate with respect to the handle assembly 12.

The handle connector 116 comprises an upper tubular portion 120 which defines a socket 122 which slidably receives the handle extension 68 of the lower handle portion 18. As shown in FIG. 4, the locking slot 110 can be formed in the tubular portion 120. A pair of spaced arms 126 having aligned bores 128 therein extend downwardly from the tubular portion 120. The tubular portion 120 is at least partially hollow to permit the passage of a fluid conduit 124 from the handle assembly 12 to the foot assembly 14. The fluid conduit 124 can be fluidly coupled at one end to the steam port 88 (FIG. 3) and at the other end to the steam distributor 98.

The foot connector 118 comprises front and rear holders 130 which can be mirror images of each other, in general. Each holder 130 comprises an upper extension 132 with an outwardly facing receiver 134 having a bore 136 formed therethrough. Each holder 130 further comprises a lower extension 138 that depends from the upper extension 132. The lower extensions 138 are curved in opposing directions, and mate together around the steam distributor 98 to form a pivot receiver 140 which receives the steam distributor 98 and defines the first axis of rotation about which the foot assembly 14 can rotate with respect to the handle assembly 12.

The foot connector 118 is coupled to the handle connector 116 by fasteners 142 which, as shown herein, include a head portion 144 and a shank portion 146. The bores 128, 136 in the handle connector 116 and foot connector 118 are aligned to receive the fasteners 142. The head portion 144 of each fastener 142 is slightly smaller in diameter than the receivers 134 in the foot connector 118, and the diameter of shank portion 146 is smaller than or about the same as the diameter of the bores 128, 136 such that the shank portion 146 can be inserted into the bores 128, 136. The aligned bores 128, 136 generally define the second axis of rotation about which the foot assembly 14 can rotate with respect to the handle assembly 12. Caps 148 can be fitted over the head portion 144 of each fastener 142 to hide the fasteners 142 from view.

Figure 6:
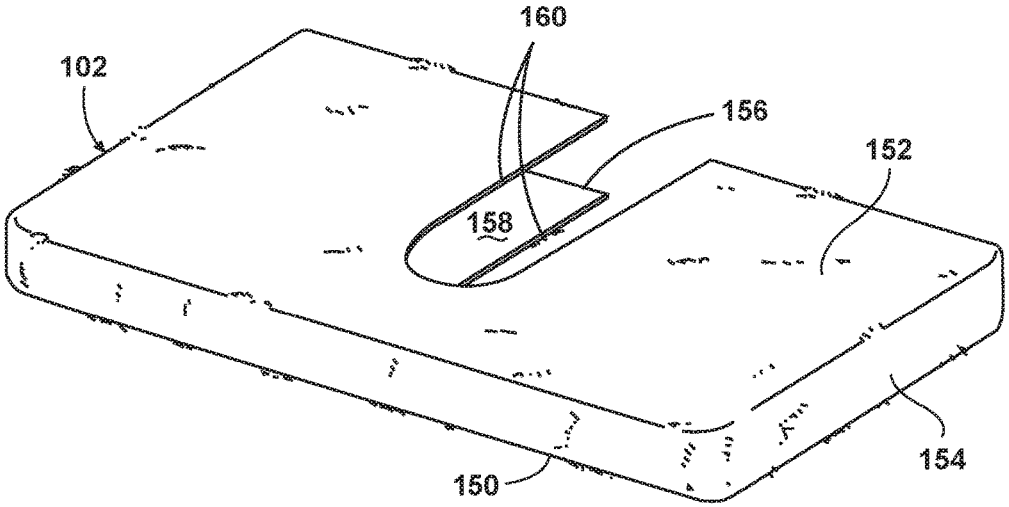
FIG. 6 is a perspective view of a cleaning pad for use with the foot assembly from FIG. 4.

FIG. 6 is a perspective view of the cleaning pad 102 for use with the foot assembly from FIG. 4. The cleaning pad 102 can comprise a pocket-like pad, with opposed first and second cleaning surfaces 150, 152, respectively that are attached to each other by a peripheral cleaning surface 154. An opening 156 in the peripheral cleaning surface 154 provides access to a pocket 158 defined by the cleaning surfaces 150, 152, 154. As illustrated, the first and second cleaning surfaces 150, 152 can be rectilinear in shape, with the opening 156 provided along one of the long sides of the first and second cleaning surfaces 150, 152. The peripheral cleaning surface 154 can extend along the remaining three sides of the first and second cleaning surfaces 150, 152. The opening 156 permits the cleaning pad 102 to be slid over the base housing 92, such that the base housing 92 is received in the pocket 158. Aligned U-shaped slots 160 which extend from the opening 156 can be provided in the first and second cleaning surfaces 150, 152 to allow for the coupling joint 100 to extend exteriorly out of the cleaning pad 102.

The first and second cleaning surfaces 150, 152 can be made of the same material. Some non-limiting examples of suitable materials are woven or non-woven textiles comprising synthetic fibers such as microfiber. The microfiber can further comprise polyester or polyolefin fibers like polypropylene or polyethylene, for example. Furthermore, additional textiles comprising natural fibers such as cotton, bamboo, and hemp, for example, are also suitable. Alternatively, the first and second cleaning surfaces 150, 152 can be made of different materials, such as materials having different textures or absorbencies. For example, the first cleaning surface 150 can have a rougher texture for vigorous scrubbing of highly soiled areas, while the second cleaning surface 152 can have a smoother texture for normal mopping.

The peripheral cleaning surface 154 can be made of the same material as the first and/or second cleaning surfaces 150, 152, or can be made of a different material. While described herein as being a cleaning surface, the peripheral cleaning surface 154 may not be used for cleaning purposes, but may simply be used to attach the first and second cleaning surfaces 150, 152 together.

Figure 7:
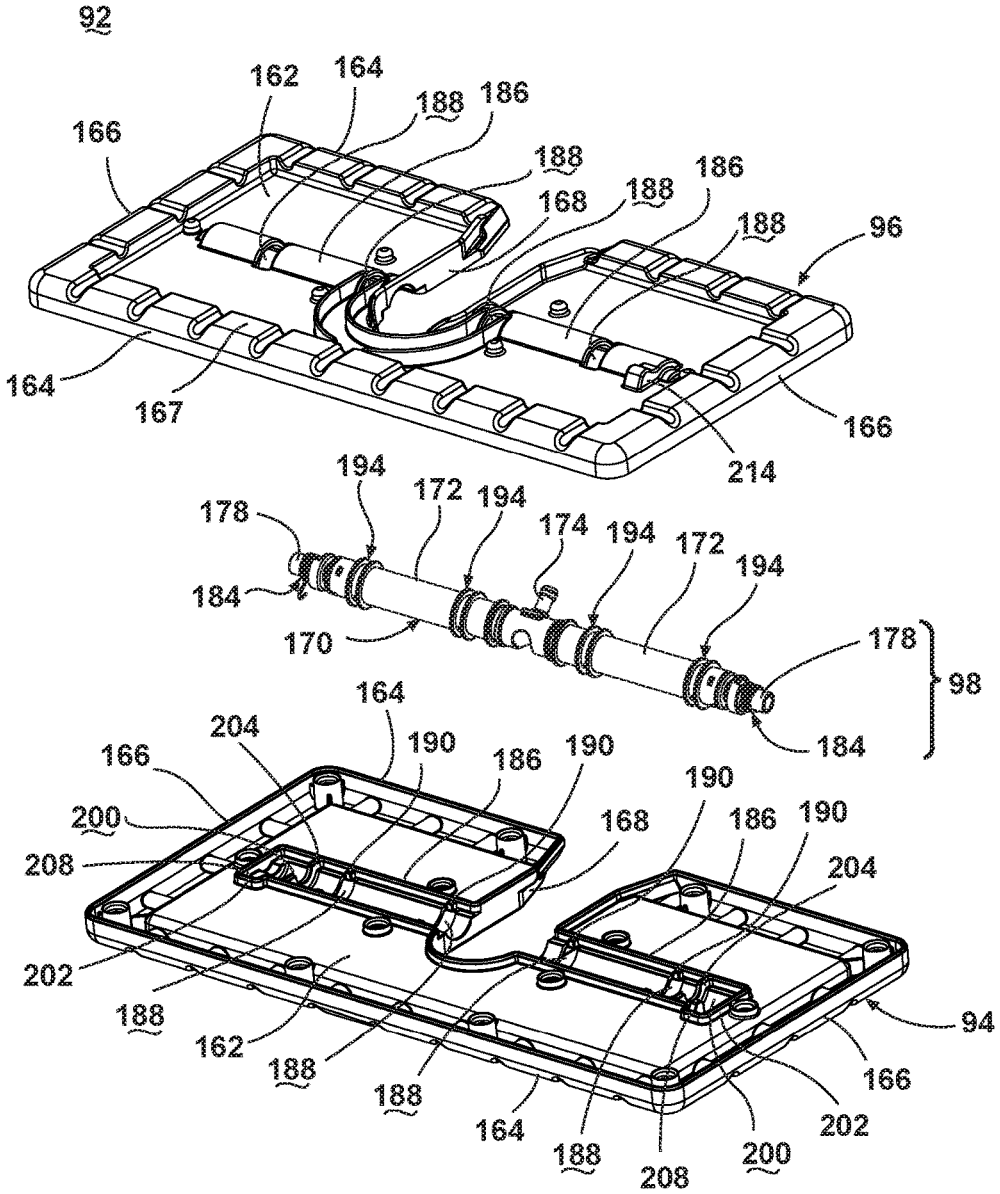
FIG. 7 is an exploded view of a base housing of the foot assembly from FIG. 4.

FIG. 7 is an exploded view of the base housing 92 the foot assembly from FIG. 4. The base housing 92 can be generally rectilinear in shape; however, the base housing 92 can be formed in other shapes commonly found on surface cleaning apparatus, such as triangular or elliptical. The first and second enclosures 94, 96 are mirror images of each other, and will therefore be described using the same reference numerals. Each enclosure 94, 96 comprises a generally rectilinear planar member 162 having a pair of long sides 164 and a pair of short sides 166. A peripheral rim 167 extends around the planar member 162, generally defining a recessed space that functions to trap steam between the base housing 92 and the surface to be cleaned, while the rim 167 contacts the surface to be cleaned. A U-shaped slot 168 extends inwardly from one of the long sides 164 and receives the portion of the coupling joint 100 (FIG. 5) which couples with the steam distributor 98. The planar member 162 further has conventional mounting bosses and structural ribbing extending therefrom.

The steam distributor 98 comprises a steam manifold 170 mounted between the first and second enclosures 94, 96. The steam manifold 170 comprises an elongated tube 172 having an inlet tube 174 extending from a central portion of the tube 172 that couples with the fluid conduit 124 (FIG. 5) passing through the coupling joint 100. The tube 172 is received by the pivot receiver 140 formed by the curved lower extensions 138 of the front and rear holders 130, with the inlet tube 174 extending upwardly from the pivot receiver 140 between the front and rear holders 130. The steam distributor 98 further comprises springs 184 that bias the base housing 92 relative to the steam manifold 170 as described in more detail below.

Figure 8:
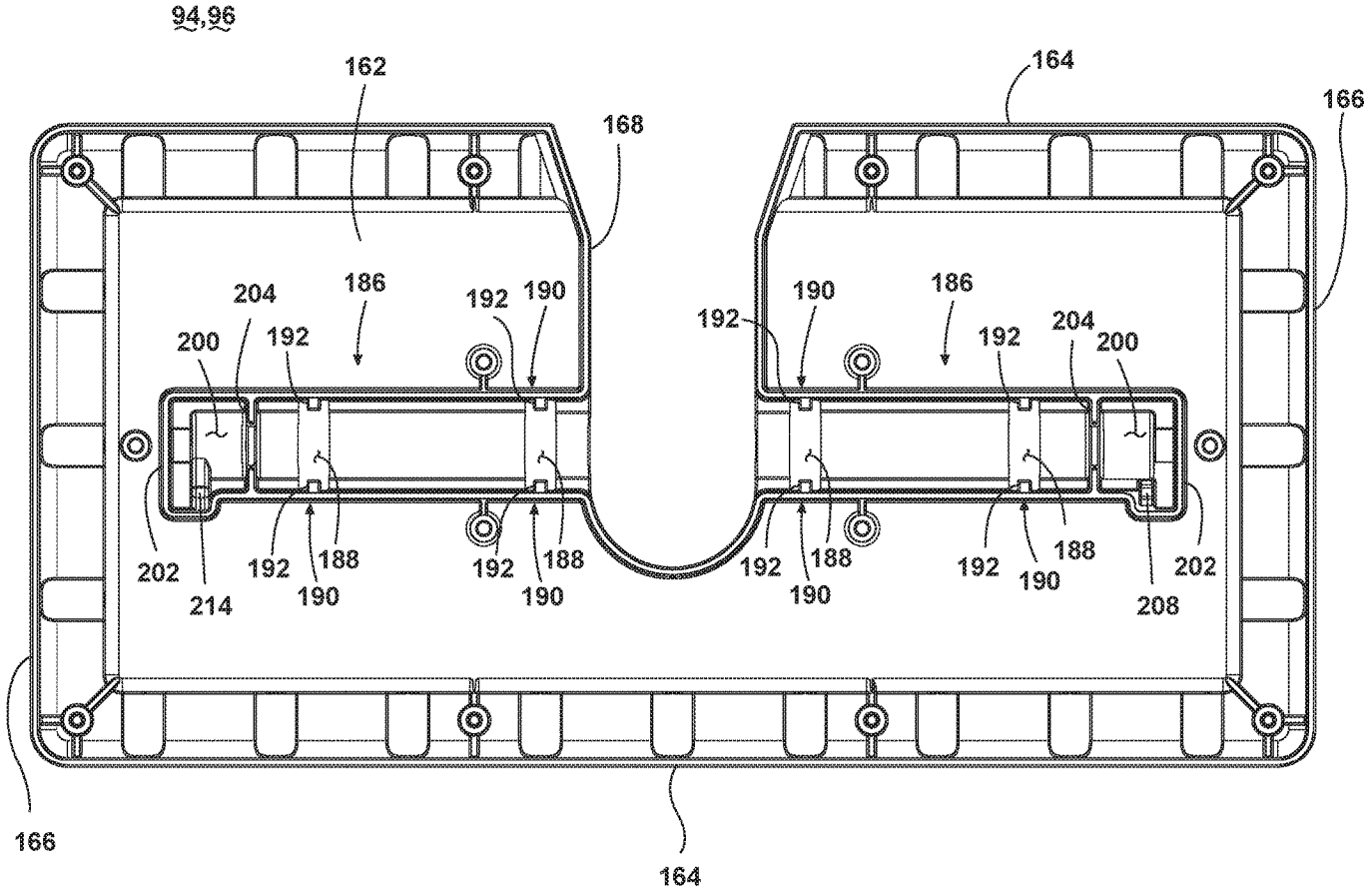
FIG. 8 is a plan view of the inner side of an enclosure of the base housing of FIG. 7.

FIG. 8 is a plan view of the inner side of the enclosures 94, 96 of FIG. 7. Since the enclosures 94, 96 are substantially identical, the description of one applies to the other. Each planar member 162 has an arcuate cradle 186 which cooperate to receive the steam manifold 170 (FIG. 7). The cradle 186 extends laterally from the U-shaped slot 168 in opposing directions and has multiple steam distribution openings 188 formed therein. The cradle 186 can further comprise multiple guides 190 formed therein. As shown herein, each guide 190 can optionally comprise a pair of opposed projections 192 adjacent to the steam distribution openings 188 that extend inwardly towards each other from an inner surface of the cradle 186.

The ends of the cradles 186 can have pockets 200 for rotatably receiving the plugs 178 and springs 184 of the steam manifold 170 therein (FIG. 7). The pockets 200 are defined between a terminal end wall 202 of the cradle 186 and a semicircular wall 204 spaced from the terminal end wall 202. A biasing protrusion 208 can be provided within one pocket 200 of each enclosure 94, 96 and can extend from an inner wall of the enclosure 94, 96 toward the interior of the central cavity formed by the enclosures 94, 96. The other pocket 200 can comprise a relief space 214. When assembled, the biasing protrusion 208 of one enclosure 94, 96 is aligned with the relief space 214 of the other enclosure 94, 96.

Figure 9:
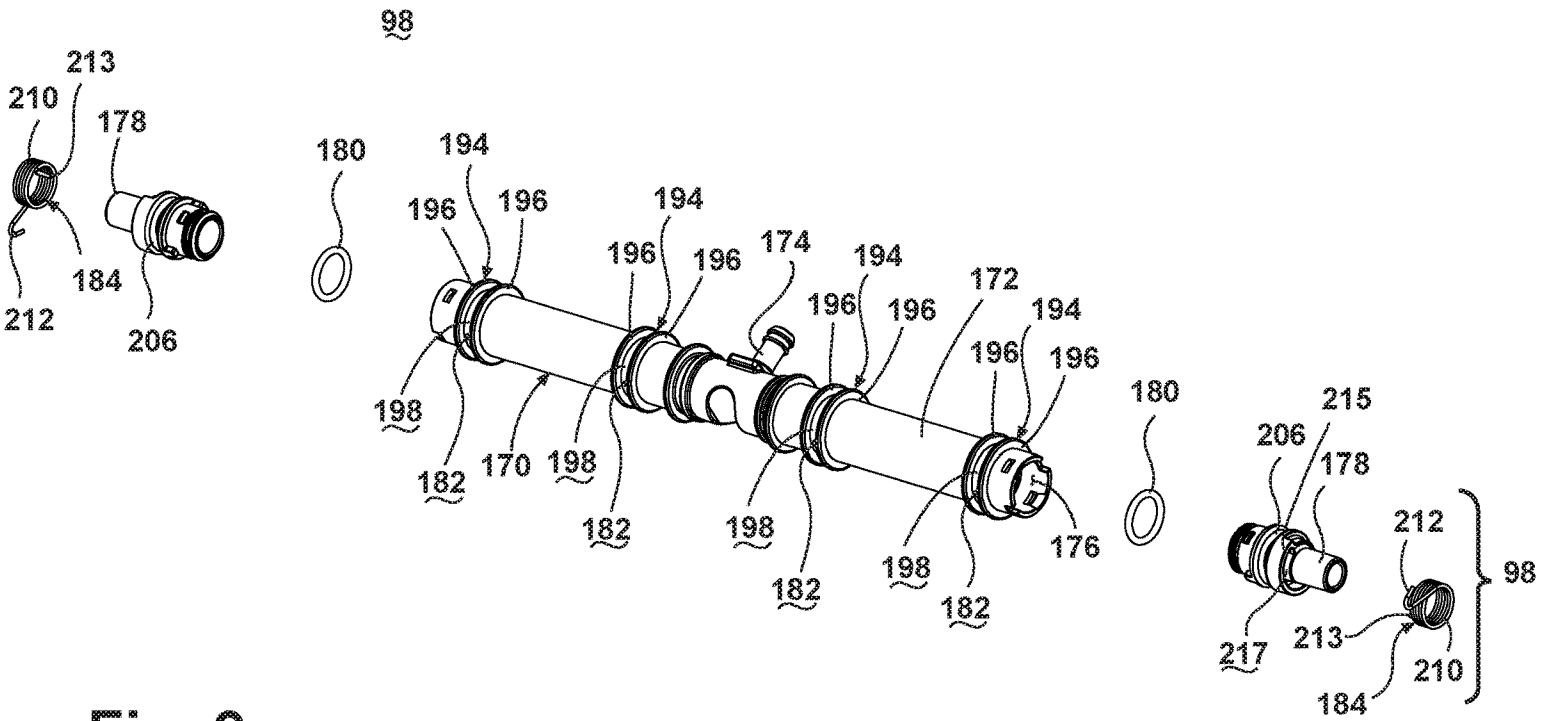
FIG. 9 is an exploded view of a steam distributor from FIG. 7.

FIG. 9 is an exploded view of the steam distributor 98 from FIG. 7. The steam manifold 170 comprises multiple outlets or steam release openings 182 that extend through the side wall of the tube 172. The steam manifold 170 is configured to form a sealed steam distribution path to guide steam outwardly from the inlet tube 174 to the steam release openings 182. The tube 172 may be at least partially hollow, with open ends 176 that receive plugs 178 which close the open ends 176 and prevent or at least reduce the escape of steam through the open ends 176. Seals or gaskets 180 can be provided between the plugs 178 and the tube 172 to prevent undesirable leaks from the steam manifold 170. The springs 184 are received on the plugs 178.

When assembled with the enclosures 94, 96, the steam release openings 182 are aligned with the steam distribution openings 188. In the embodiment shown herein, a single row of steam release openings 182 are provided, with one steam release opening 182 provided per the paired steam distribution openings 188 in the enclosures 94, 96. Since only one row is provided, the steam release openings 182 will fluidly communicate with the steam distribution openings 188 in only one enclosure 94, 96 at a time. Thus, steam passes through only one side of the foot assembly 14 at a time. As is described below, the foot assembly 14 is configured such that steam passes through the side of the foot assembly 14 resting on the surface to be cleaned. Specifically, steam from the steam release openings 182 is passed through the steam distribution openings 188 in the enclosure 94, 96 resting on the surface to be cleaned, and passes through the cleaning pad 102 onto the surface to be cleaned.

The steam manifold 170 further optionally comprises multiple corresponding tracks 194 that receive the guides 190 on the enclosures 94, 96 (FIG. 8). As shown herein, each track 194 can comprise a pair of circumferential ribs 196 formed on the manifold tube 172 and defining a space 198 therebetween in which the projections 192 are received. Thus, the guides 190 can slide within the tracks 194 such that the steam manifold 170 can rotate relative to the enclosures 94, 96, but is restrained from moving laterally within the enclosures 94, 96 by the ribs 196. The steam release openings 182 can be located within the tracks 194, or elsewhere on the manifold 170. The plugs 178 further have a neck portion 206 that is received by the semicircular wall 204 and which rides along the semicircular wall 204 as the steam manifold 170 rotates with respect to the enclosures 94, 96.

As shown herein, the springs 184 can comprise helical torsion springs, each having a coiled portion 210 that wraps around a portion of the plug 178, a free end 212 extending from the coiled portion 210 that can optionally be bent as shown herein, and a pin end 213 that is bent along an axis that is parallel to the axis of the coiled portion 210. The pin end 213 is adapted to engage an arcuate track 217 formed in an outer face of the plug 178. The track 217 extends approximately 180 degrees around the face of the plug 178 and further comprises a stop 215 at both ends thereof, only one of which is visible in FIG. 9. The stops 215 are configured to selectively engage the pin end 213 of the spring 184 while features in the base housing 92 simultaneously engage the free end 212, and thus selectively apply tension to the coiled portion 210 of the spring 184 as the foot assembly 14 rotates with respect to the handle assembly 12 about axis X during use.

Figure 10:
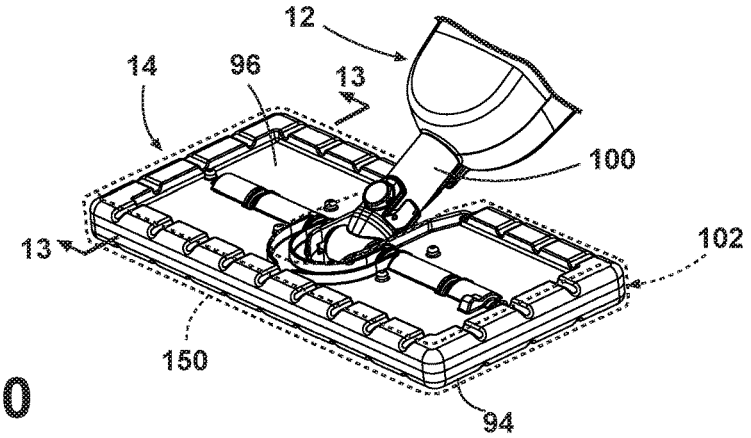
FIG. 10 is a front perspective view of the foot assembly from FIG. 1, with the foot assembly in a first use position.
Figure 11:
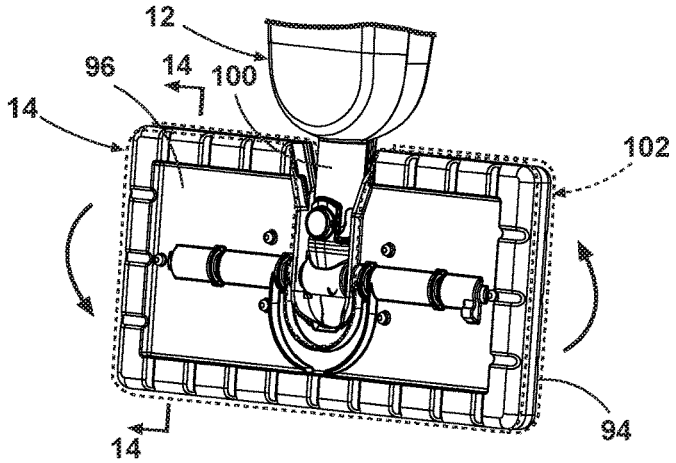
FIG. 11 is a front perspective view of the foot assembly from FIG. 1, with the foot assembly in a neutral or transition position.
Figure 12:
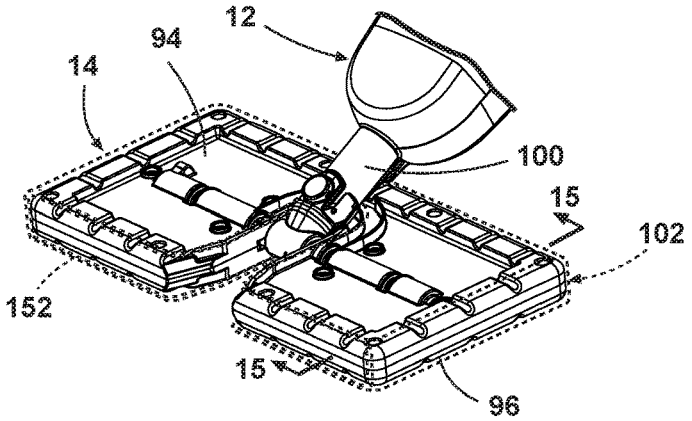
FIG. 12 is a front perspective view of the steam mop from FIG. 1, with the foot assembly in a second use position.

Referring to FIGS. 10-15, the foot assembly 14 is moveable between a first use position, shown in FIG. 10, in which one side of the cleaning pad 102 engages the surface to be cleaned, and a second use position, shown in FIG. 12, in which another side of the cleaning pad 102 engages the surface to be cleaned. Since the foot assembly 14 is freely moveable between the first and second use positions, both side of the cleaning pad 102 can be used during a cleaning operation.

As shown in FIG. 10, when the foot assembly 14 rests on a floor surface in the first use position, the second enclosure 96 defines the top of the base housing 92 and the first enclosure 94 defines the bottom of the base housing 92. Thus, the first enclosure 94 rests on the floor surface. With the cleaning pad 102 received on the base housing 92, the first cleaning surface 150 will engage the floor surface. As shown in FIG. 12, when the foot assembly 14 rests on a floor surface in the second use position, the first enclosure 94 defines the top of the base housing 92 and the second enclosure 96 defines the bottom of the base housing 92. Thus, the second enclosure 96 rests on the floor surface. With the cleaning pad 102 received on the base housing 92, the second cleaning surface 152 will engage the floor surface.

Figure 13:
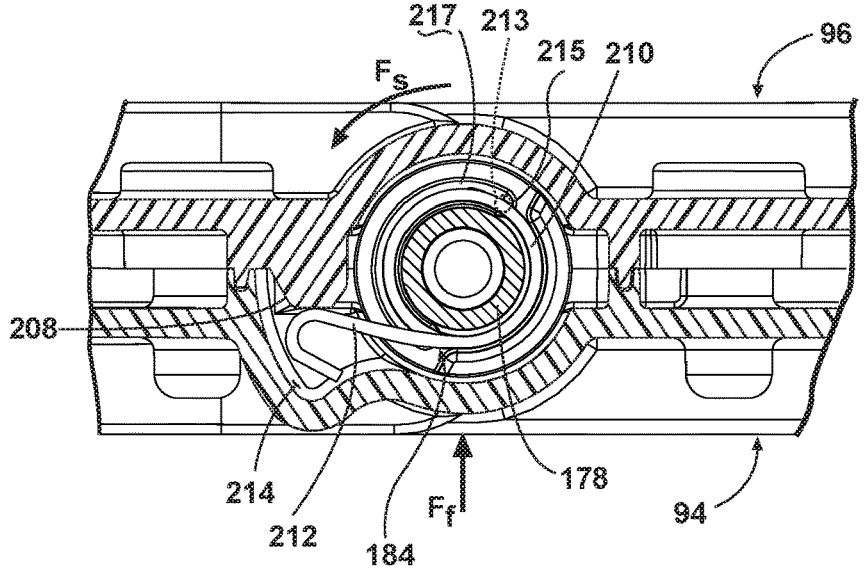
FIG. 13 is a cross-sectional view of the foot assembly taken along line 13-13 of FIG. 10.

FIG. 13 is a cross-sectional view through line 13-13 of FIG. 10, showing the right-hand spring 184 when the foot assembly 14 is in the first use position. The biasing protrusion 208 can be offset from the associated plug 178 that is received within the pocket 200, such that the free end 212 of the spring 184 is adjacent to the biasing protrusion 208. When the foot assembly 14 is resting against a floor surface in the first use position, the base housing 92 will be generally parallel to the floor surface. In this position, the right-hand spring 184 is under compression by the free end 212 of the right-hand spring 184, which is biased against the biasing protrusion 208 of the second enclosure 96, and the pin end 213, which is engaged by the stop 215 at the end of the track 217, thus tending to pivot the base housing 92 downwardly relative to the coupling joint 100 when the foot assembly 14 is lifted off the floor as shown in FIG. 11. In the first use position, the right-hand spring 184 imposes a rotational force $F_S$ against the biasing protrusion 208, which is overcome by a force $F_F$ imposed on the foot assembly 14 by the floor surface. While not shown, the left-hand spring 184 is not compressed. The free end 212 rests against the biasing protrusion 208 of the first enclosure 94 and the pin end 213 floats freely in the track 217 between the stops 215. When the foot assembly 14 is lifted away from the floor surface, the foot assembly 14 automatically moves from the first use position of FIG. 10 to a neutral or transition position shown in FIG. 11 in which the base housing 92 is rotated downwardly relative to the coupling joint 100 and the handle assembly 12, such that the base housing 92 is in a more or less vertical orientation with respect to the floor surface.

Figure 14:
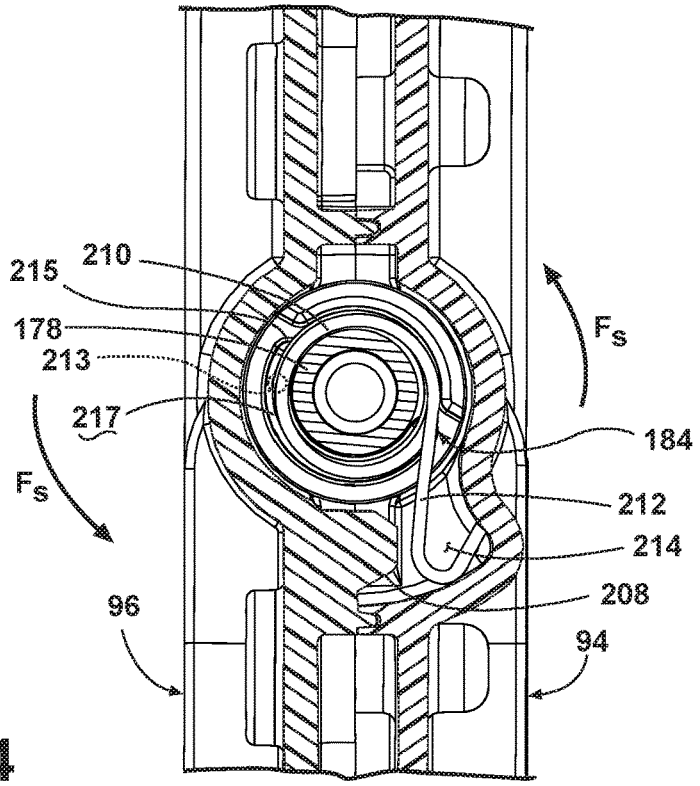
FIG. 14 is a cross-sectional view of the foot assembly taken along line 14-14 of FIG. 11.

FIG. 14 is a cross-sectional view through line 14-14 of FIG. 11, showing the right-hand spring 184 when the foot assembly is in the neutral or transition position. When the force $F_F$ imposed on the foot assembly 14 by the floor surface is removed, i.e. when the foot assembly 14 is lifted away from the floor surface, the rotational force $F_S$ of the right-hand spring 184 applies rotational force to the base housing 92 by biasing the biasing protrusion 208 of the second enclosure 96 away from the free end 212 of the spring 184, which forces the base housing 92 into a substantially vertical position. In the vertical position, the right- and left-hand springs 184 oppose each other to maintain the foot in the substantially vertical position. In this position, neither pin end 213 engages the stops 215. Alternatively, both pin ends 213 engage their respective stops 215, such that a small amount of preload force from each spring 184 opposes each other to urge the foot assembly 14 toward the substantially vertical position.

To place the foot assembly 14 in the second use position shown in FIG. 12 from the transition position shown in FIG. 11, the user can place a portion of the downwardly-facing long side of the base housing 92 against the floor surface, and use the handle assembly 12 to apply force to the base housing 92, causing rotation of the base housing 92 in a desired direction.

Figure 15:
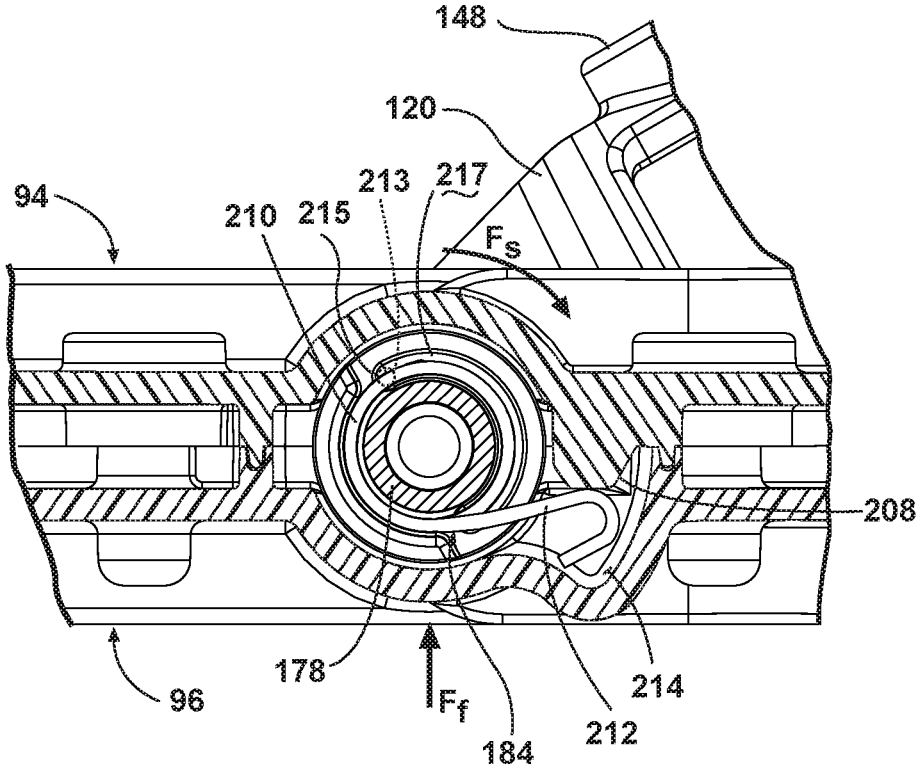
FIG. 15 is a cross-sectional view of the foot assembly taken along line 15-5 of FIG. 12.

FIG. 15 is a cross-sectional view through line 15-5 of FIG. 12, showing the left-hand spring 184 when the foot assembly 14 is in the second use position. When the foot assembly 14 is resting against a floor surface in the second use position, the base housing 92 is generally parallel to the floor surface. In this position, the left-hand spring 184 is compressed by the free end 212, which is biased against the biasing protrusion 208 of the first enclosure 94, and the pin end 213, which is engaged by the stop 215 at the end of the track 217 as shown in FIG. 15. While not shown, the right-hand spring 184 is not compressed. The free end 212 rests against the biasing protrusion 208 of the second enclosure 96 and the pin end 213 floats freely in the track 217 between the stops 215. The left-hand spring 184 imposes a rotational force $F_S$ against the biasing protrusion 208, which is overcome by a force $F_F$ imposed on the foot assembly 14 by the floor surface.

It is noted that the steam release openings 182 of the steam distributor 98 are configured to be in fluid communication with the steam distribution openings 188 of the enclosure 94, 96 that defines the bottom of the base housing 92. Thus, steam is always supplied through the enclosure 94, 96 that is in contact with or facing the floor surface. This arrangement permits steam to be continually applied directly towards the floor surface, regardless of which side of the base housing 92 is in contact with or facing the floor surface, i.e. regardless of whether the foot assembly 14 is in the first or second use position.

Figure 16:
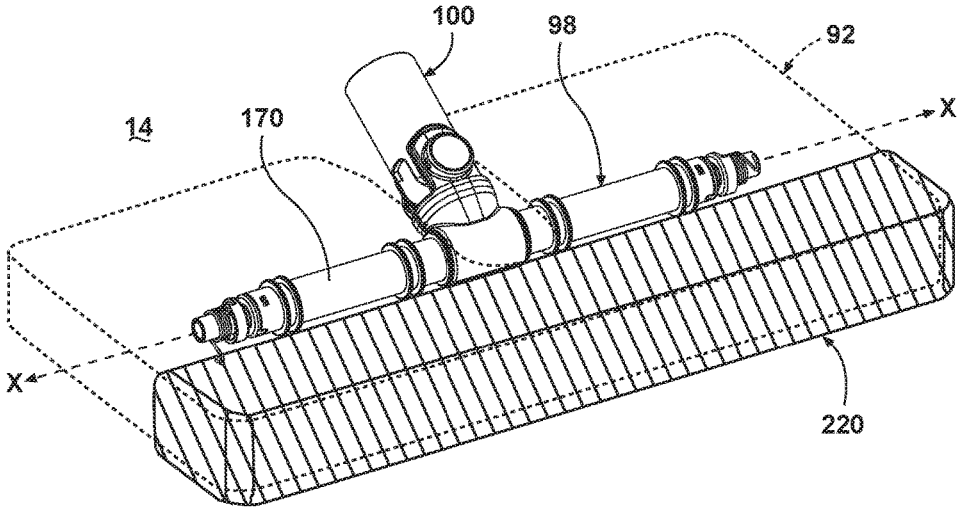
FIG. 16 is a schematic view of a foot assembly according to a second embodiment of the invention.

FIG. 16 is a schematic view of a foot assembly 14 according to a second embodiment of the invention. The second embodiment of the invention may be substantially similar to the first embodiment shown in FIGS. 1-15, but may differ by the provision of a weighted portion 220 on the foot assembly 14. Specifically, the weighted portion 220 may be located along one long side of the base housing 92. This places more of the mass of the foot assembly 14 on one side of the axis of rotation X. Since the majority of the mass of the foot assembly 14 is offset from the axis of rotation X, the foot assembly 14 will have a greater moment of inertia in comparison with the first embodiment shown in FIGS. 1-15, in which the mass of the foot assembly 14 is more balanced with respect to the axis of rotation X. The weighted portion 220 can be in the form of an added component to the base housing 92, or may be integrally formed with the base housing 92.

The foot assembly 14 is moveable between a first use position, in which one side of a cleaning pad, such as cleaning pad 102 from FIG. 6, can engage the surface to be cleaned, and a second use position in which another side of the cleaning pad can engage the surface to be cleaned. When the foot assembly 14 rests on a floor surface in either use position, the foot assembly 14 will be substantially horizontal to the floor surface, as shown in FIG. 16. When the foot assembly 14 is lifted away from the floor surface, the off-set mass of the foot assembly 14 provided by the weighted portion 220 will automatically rotate the foot assembly 14 downwardly relative to the coupling joint 100 and the handle assembly 12, such that the base housing 92 is in a more or less vertical orientation with respect to the floor surface.

Figure 17:
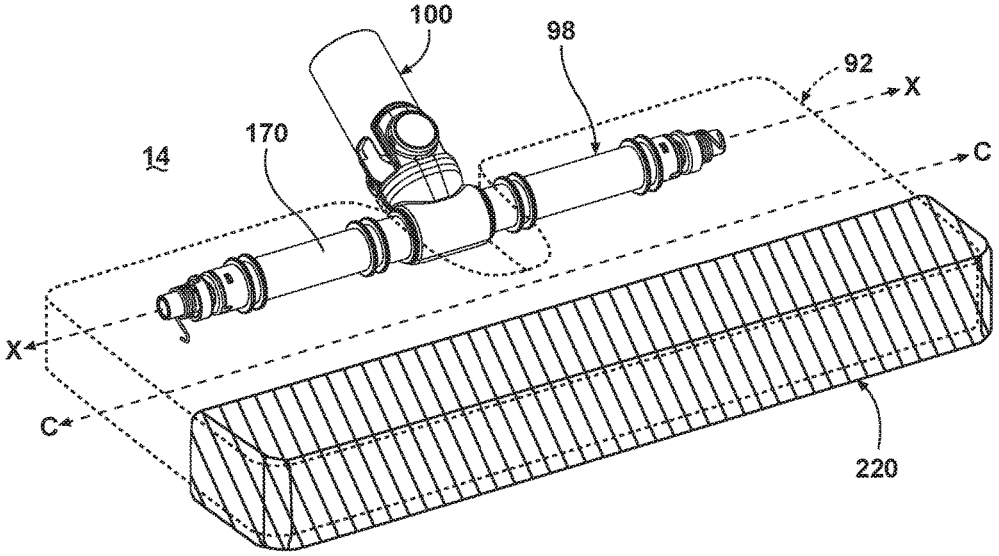
FIG. 17 is a schematic view of a foot assembly according to a third embodiment of the invention.

FIG. 17 is a schematic view of a foot assembly 14 according to a third embodiment of the invention. The third embodiment of the invention may be substantially similar to the second embodiment shown in FIG. 16, but may differ in that the steam distributor 98 is positioned off-center with respect to a longitudinal centerline C of the base housing 92. Specifically, the position of the steam manifold 170 may be biased toward one long side of the base housing 92. This offsets the axis of rotation X, thereby placing more of the mass of the foot assembly 14 on one side of the axis of rotation. As shown, when combined with the weighted portion 220, the steam manifold 170 may be biased away from the side of the base housing 92 comprising the weighted portion 220. Since the majority of the mass of the foot assembly 14 is farther away from the axis of rotation X, the foot assembly 14 will have a greater moment of inertia in comparison with the second embodiment shown in FIG. 16, in which the mass of the foot assembly 14 is more balanced with respect to the axis of rotation. The foot assembly 14 can alternatively be provided with the off-center steam manifold 170 but without the weighted portion 220.

The foot assembly 14 is moveable between a first use position, in which one side of a cleaning pad, such as cleaning pad 102 from FIG. 6, can engage the surface to be cleaned, and a second use position in which another side of the cleaning pad can engage the surface to be cleaned. When the foot assembly 14 rests on a floor surface in either use position, the foot assembly 14 will be substantially horizontal to the floor surface, as shown in FIG. 17. When the foot assembly 14 is lifted away from the floor surface, the off-set mass of the foot assembly 14 provided by the offset axis of rotation X will automatically rotate the foot assembly 14 downwardly relative to the coupling joint 100 and the handle assembly 12, such that the base housing 92 is in a more or less vertical orientation with respect to the floor surface.

Figure 18:
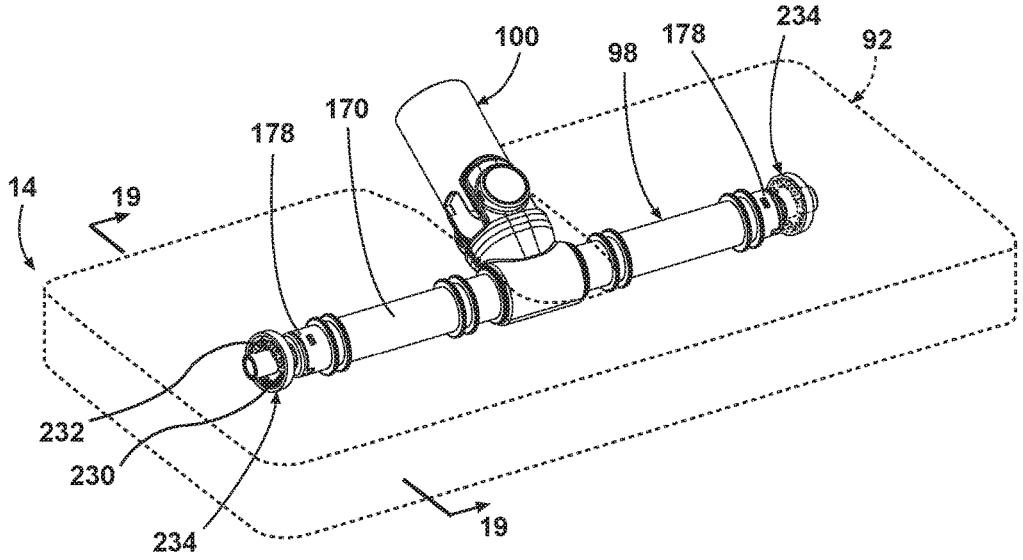
FIG. 18 is a schematic view of a foot assembly according to a fourth embodiment of the invention.

FIG. 18 is a schematic view of a foot assembly 14 according to a fourth embodiment of the invention. The fourth embodiment of the invention may be substantially similar to the first embodiment shown in FIGS. 1-15, but may differ by the provision of linear compression springs 230, 232 configured to apply rotational force to the foot assembly 14 when the foot assembly 14 is lifted off a floor surface, rather than the torsion springs 184 employed by the first embodiment.

Figure 19:
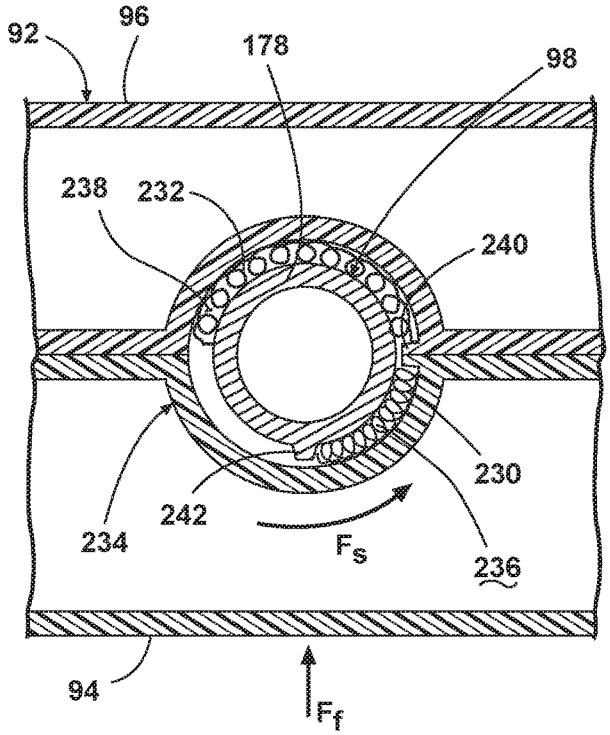
FIG. 19 is a schematic sectional view through line 19-19 of FIG. 18, illustrating the foot assembly in a first use position.
Figure 21:
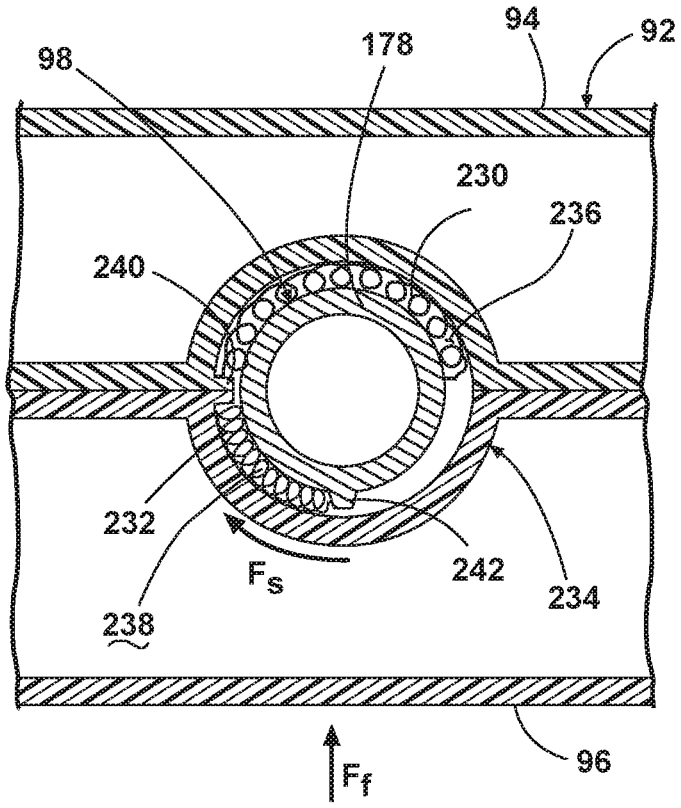
FIG. 21 is a view similar to FIG. 19, illustrating the foot assembly in a second use position.

The foot assembly 14 is moveable between a first use position, shown in FIG. 19, in which one side of a cleaning pad, such as cleaning pad 102 from FIG. 6, can engage the surface to be cleaned, and a second use position, shown in FIG. 21, in which another side of the cleaning pad can engage the surface to be cleaned. In the first use position, the second enclosure 96 defines the top of the base housing 92 and the first enclosure 94 defines the bottom of the base housing 92 and rests on the floor surface. In the second use position, the first enclosure 94 defines the top of the base housing 92 and the second enclosure 96 defines the bottom of the base housing 92 and rests on the floor surface. Since the foot assembly 14 is freely moveable between the first and second use positions, both side of the cleaning pad can be used during a cleaning operation.

FIG. 19 is a schematic sectional view through line 19-19 of FIG. 18, illustrating the base housing 92 of the foot assembly 14 in the first use position. The base housing 92 can comprise a circular channel 234 at each opposing end of the steam distributor 98. The channel is divided into two channel sections 236, 238 by a first partition 240 provided on the base housing 92 and a second partition 242 provided on the steam distributor 98. As shown herein, the first partition 240 can be formed by cooperating protrusions on the enclosures 94, 96, and the second partition 242 can be formed by a protrusion extending from the plug 178 on the steam manifold 170. Alternatively, the second partition 242 can be formed on another portion of the steam distributor 98, such as the steam manifold 170 itself. Since the steam distributor 98 is movable with respect to the base housing 92, the second partition 242 can move relative to the first partition 240, thereby changing the size or length of the channel sections 236, 238.

The first linear compression spring 230 is provided within the first channel section 236 and can selectively float between the first and section partitions 240, 242. Likewise, the second linear compression spring 232 is provided within the second channel section 238 and can selectively float between the first and section partitions 240, 242.

As shown in FIG. 19, when the foot assembly 14 rests on a floor surface in the first use position, the steam distributor 98 is rotated such that the second partition 242 moves towards the first partition 240, which compresses the first spring 230 therebetween. The first spring 230 imposes a rotational force $F_S$ against the partitions 240, 242, which is overcome by a force $F_F$ imposed on the foot assembly 14 by the floor surface. In the first use position, the second channel section 238 is longer the first channel section 236. The second spring 232 is slack within the second channel section 238 and will not impose any substantial force against the partitions 240, 242.

Figure 20:
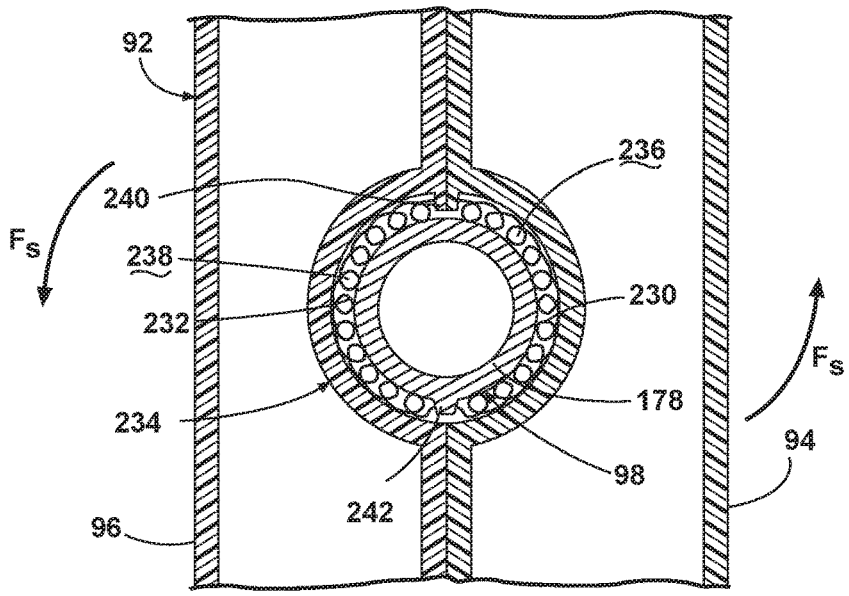
FIG. 20 is a view similar to FIG. 19, illustrating the foot assembly in a transition position.

When the foot assembly 14 is lifted away from the floor surface, the foot assembly 14 will automatically move from the first use position shown in FIG. 19 to a transition position shown in FIG. 20 in which the base housing 92 is rotated downwardly relative to the coupling joint 100 and the handle assembly 12, such that the base housing 92 is in a more or less vertical orientation with respect to the floor surface.

FIG. 20 is a cross-sectional view similar to FIG. 19, showing the foot assembly 14 in the transition position. When the force $F_F$ imposed on the foot assembly 14 by the floor surface is removed, the compressed first spring 230 will bias the first partition 240 away from the second partition 242, thereby rotating the base housing 92 relative to the steam distributor 98 to a generally vertical position as shown in FIG. 20. In this position, the channel sections 236, 238 have substantially equal lengths, and the rotational force $F_S$ of the springs 230, 232 are balanced. Alternatively, the springs 230, 232 can be configured to be slack within their respective channel section 236, 238 in the transition position, such that the springs will not impose any substantial force against the partitions 240, 242.

To place the foot assembly 14 in the second use position shown in FIG. 21 from the transition position shown in FIG. 20, the user can place a portion of the downwardly-facing long side of the base housing 92 against the floor surface, and use the handle assembly 12 to apply force to the base housing 92, causing rotation of the base housing 92 in a desired direction. The steam distributor 98 is rotated such that the second partition 242 moves towards the first partition 240 to compress the second spring 232 therebetween, as shown in FIG. 21. The second spring 232 imposes a rotational force $F_S$ against the partitions 240, 242, which is overcome by a force $F_F$ imposed on the foot assembly 14 by the floor surface. In the second use position, the first channel section 236 is longer the second channel section 238. The first spring 230 is slack within the first channel section 236 and will not impose any substantial force against the partitions 240, 242.

Figure 22:
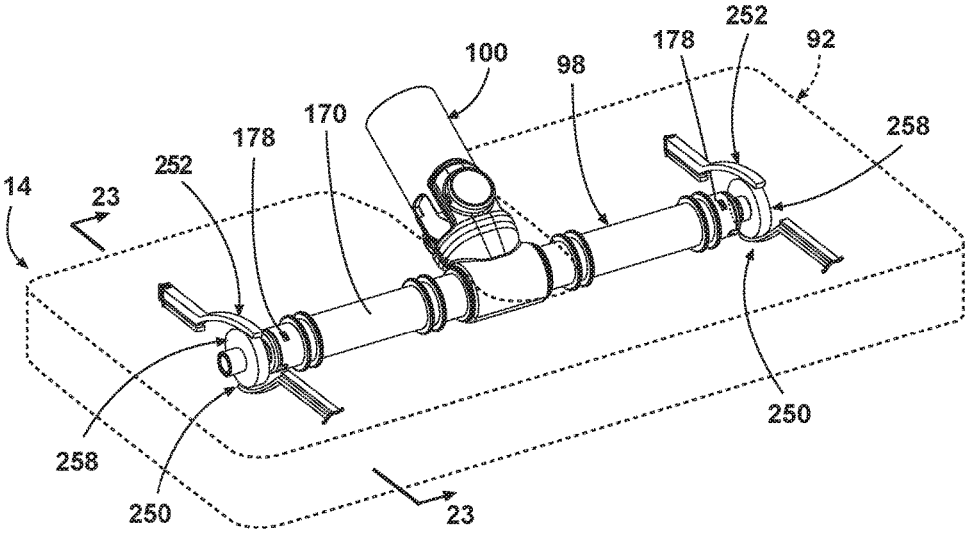
FIG. 22 is a schematic view of a foot assembly according to a fifth embodiment of the invention.

FIG. 22 is a schematic view of a foot assembly 14 according to a fifth embodiment of the invention. The fifth embodiment of the invention may be substantially similar to the first embodiment shown in FIGS. 1-15, but may differ by the provision of flat springs 250, 252 configured to apply rotational force to the foot assembly 14 when the foot assembly 14 is lifted off a floor surface, rather than the torsion springs 184 employed by the first embodiment.

Figure 23:
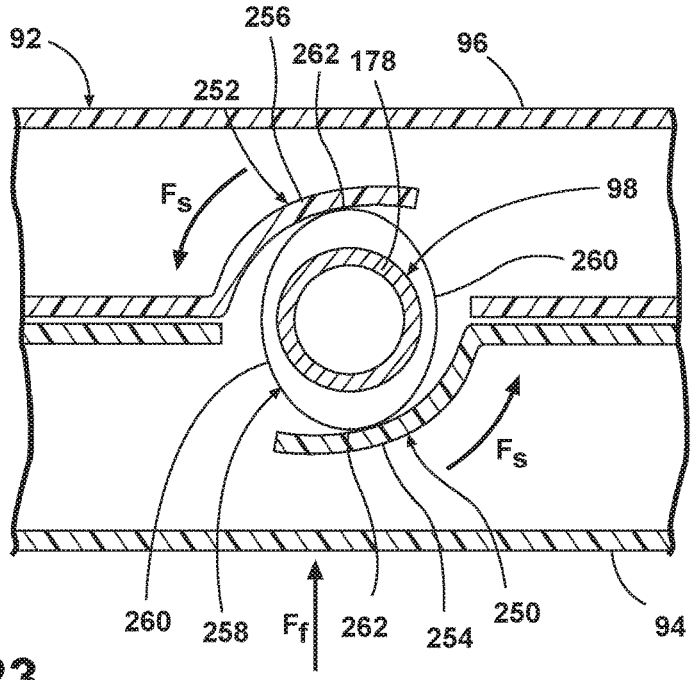
FIG. 23 is a schematic sectional view through line 23-23 FIG. 22, illustrating the foot assembly in a first use position.
Figure 25:
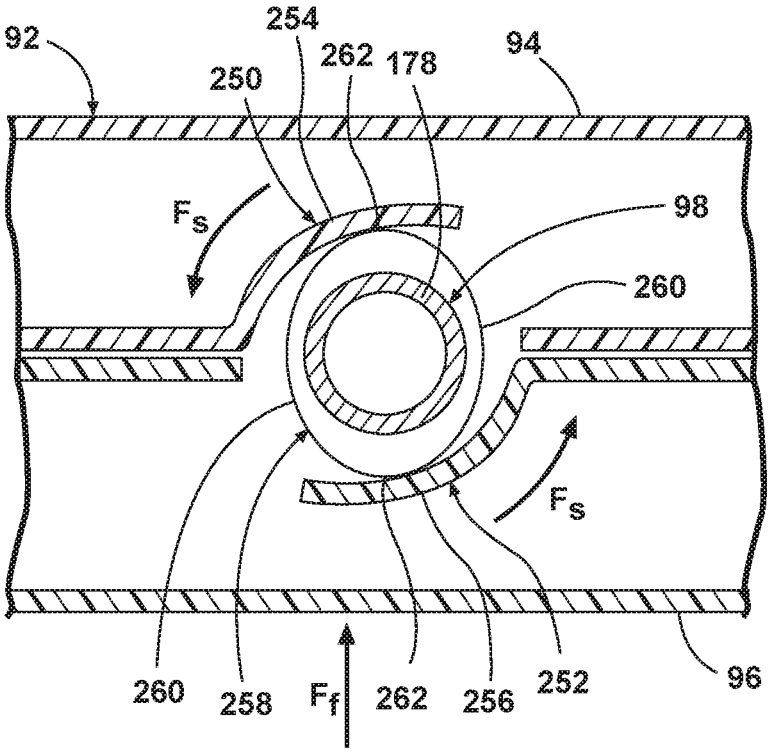
FIG. 25 is a view similar to FIG. 23, illustrating the foot assembly in a second use position.

The foot assembly 14 is moveable between a first use position, shown in FIG. 23, in which one side of a cleaning pad, such as cleaning pad 102 from FIG. 6, can engage the surface to be cleaned, and a second use position, shown in FIG. 25, in which another side of the cleaning pad can engage the surface to be cleaned. In the first use position, the second enclosure 96 defines the top of the base housing 92 and the first enclosure 94 defines the bottom of the base housing 92 and rests on the floor surface. In the second use position, the first enclosure 94 defines the top of the base housing 92 and the second enclosure 96 defines the bottom of the base housing 92 and rests on the floor surface. Since the foot assembly 14 is freely moveable between the first and second use positions, both sides of the cleaning pad can be used during a cleaning operation.

FIG. 23 is a schematic sectional view through line 23-23 of FIG. 22, illustrating the base housing 92 of the foot assembly 14 in the first use position. The foot assembly 14 can comprise a first pair of flat springs 250 associated with the first enclosure 94 and a second pair of flat springs 252 associated with the second enclosure 96. As illustrated herein, the first flat springs 250 can be formed as first resilient arms 254 integrally formed with the first enclosure 94 and the second flat springs 252 can be formed as resilient second arms 256 integrally formed with the second enclosure 96. The arms 254, 256 can extend in opposing directions. Alternatively, the springs 250, 252 can be formed separately from the enclosures 94, 96, and can simply be attached or mounted thereto.

The foot assembly 14 further comprises a cam 258 at each opposing end of the steam distributor 98 and it rotatable therewith. As shown herein, the cam 258 can be provided on the plug 178 on the steam manifold 170. Alternatively, the cam 258 can be provided on another portion of the steam distributor 98, such as the steam manifold 170 itself. The cam 258 has an outer surface defining the profile of the cam 258. As shown, the profile of the cam 258 is generally oblong, with side surfaces 260 that are generally flat and parallel, and end surfaces 262 that are more rounded. The side surfaces 260 can be closer together in comparison to the end surfaces 262. In general, the profile shape of the cam 258 is not critical to the invention, as long as the foot assembly 14 can function as described below. The arms 254, 256 are positioned to engage the cam 258, with the cam 258 generally received between the arms 254, 256. Therefore, the arms 254, 256 function as cam followers in the present embodiment.

As shown in FIG. 23, when the foot assembly 14 rests on a floor surface in the first use position, the steam distributor 98 is rotated such that the end surfaces 262 of the cam 258 engage the resilient arms 254, 256, thereby forcing them apart. The resilient arms 254, 256 cooperatively impose a rotational force $F_S$ against the cam 258, which is overcome by a force $F_F$ imposed on the foot assembly 14 by the floor surface.

Figure 24:
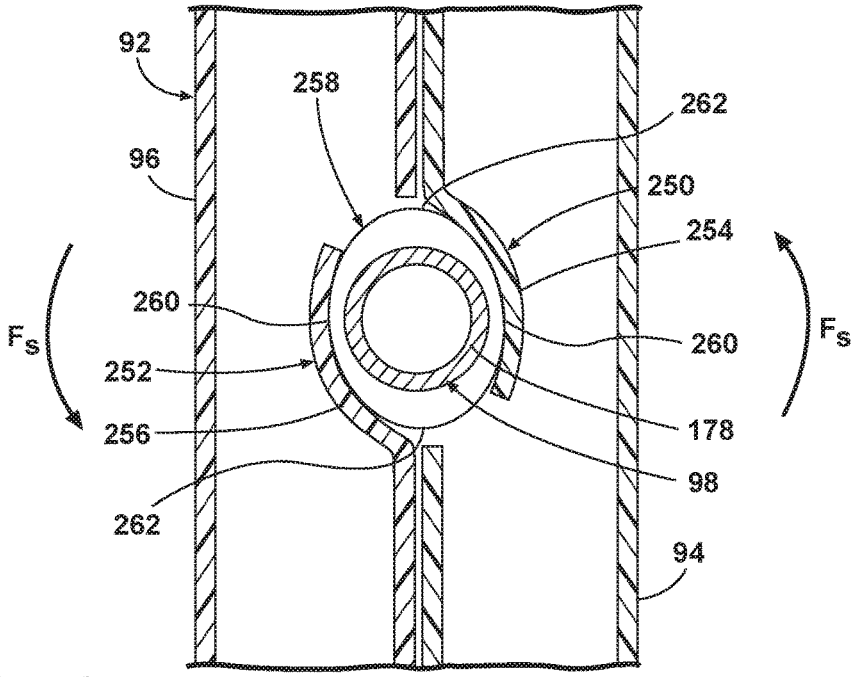
FIG. 24 is a view similar to FIG. 23, illustrating the foot assembly in a transition position.

When the foot assembly 14 is lifted away from the floor surface, the foot assembly 14 will automatically move from the first use position shown in FIG. 23 to a transition position shown in FIG. 24 in which the base housing 92 is rotated downwardly relative to the coupling joint 100 and the handle assembly 12, such that the base housing 92 is in a more or less vertical orientation with respect to the floor surface.

FIG. 24 is a cross-sectional view similar to FIG. 23, showing the foot assembly 14 in the transition position. When the force $F_F$ imposed on the foot assembly 14 by the floor surface is removed, the rotational force $F_S$ of the deflected arms 254, 256 will rotate the cam 258, such that the arms 254, 256 engage the side surfaces 260 of the cam 258.

To place the foot assembly 14 in the second use position shown in FIG. 25 from the transition position shown in FIG. 24, the user can place a portion of the downwardly-facing long side of the base housing 92 against the floor surface, and use the handle assembly 12 to apply force to the base housing 92, causing rotation of the base housing 92 in a desired direction. The steam distributor 98 is rotated, which concurrently rotates the cam 258 between the flat springs 250, 252, such that the end surfaces 262 of the cam 258 engages the resilient arms 254, 256, thereby forcing them apart, as shown in FIG. 25. The resilient arms 254, 256 cooperatively impose a rotational force $F_S$ against the cam 258, which is overcome by a force $F_F$ imposed on the foot assembly 14 by the floor surface.

Figure 26:
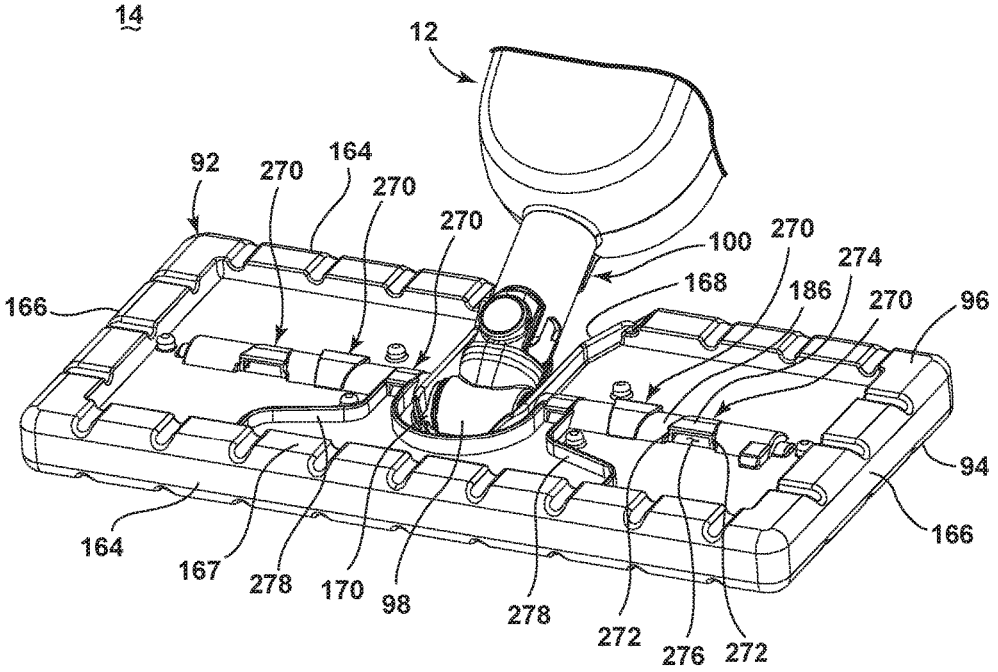
FIG. 26 is a perspective view of a foot assembly according to a sixth embodiment of the invention.

FIG. 26 is a perspective view of a foot assembly 14 according to a sixth embodiment of the invention. The sixth embodiment of the invention may be substantially similar to the first embodiment shown in FIGS. 1-15, but may differ by the provision of hooded members 270 configured to direct steam delivered from the steam release openings 182 (FIG. 9) toward the surface to be cleaned. The number of hooded members 270 can correspond to the number of steam release openings 182; in the embodiment shown herein, six steam release openings 182 and hooded members 270 are provided.

The hooded members 270 can be provided on each enclosure 94, 96 of the base housing 92, and can comprise two spaced side walls 272 extending from an exterior surface of the enclosure 94, 96 and a top wall 274 joining the side walls 272. As shown, the side walls 272 extend from the cradles 186 which cooperate to receive the steam manifold 170. The side and top walls 272, 274 define a hood opening 276 which releases steam. The hood openings 276 can be arranged in different directions, such that some hood openings 276 face one long side 164 of the base housing 92 and some hood openings 276 face the other long side 164 of the base housing 92. As shown, the hood openings 276 face alternating directions. The hood openings 276 are further oriented to direct at least some steam parallel to the surface to be cleaned during operation.

Guide ribs 278 are further provided on the base housing 92 for further directing steam delivered from the steam release openings 182 (FIG. 9) toward the surface to be cleaned. The guide ribs 278 can be provided on each enclosure 94, 96 of the base housing 92, and can extend from one or more of the hooded members 270 for further guiding the steam released through the hood openings 276. As shown, the guide ribs 278 extend from the innermost hooded members 270 to the rim 167 provided on the long side 164 of the base housing 92 that does not include the U-shaped slot 168. The guide ribs 278 flare outwardly from each other toward the rim 167, which increases the area defined by the guide ribs 278 and allows steam to spread out along the long side 164 of the base housing 92.

While the invention has been specifically described in connection with certain specific embodiments thereof, it is to be understood that this description is by way of illustration and not of limitation, and the scope of the appended claims should be construed as broadly as the prior art will permit. Reasonable variation and modification are possible within the foregoing specification and drawings without departing from the spirit of the invention, which is set forth in the accompanying claims.

What is claimed is:

1. A surface cleaning apparatus comprising:

a foot assembly adapted to move across a surface to be cleaned and comprising a base housing;

a handle assembly pivotally attached to the foot assembly and comprising a steam distributor and steam generator in fluid communication with the steam distributor;

a cleaning pad on the base housing and having opposed first and second cleaning surfaces; and a coupling joint pivotally attaching the foot assembly to the handle assembly and defining a first axis of rotation, wherein the foot assembly is swivelable relative to the handle assembly about the first axis of rotation between:

a first use position in which the first cleaning surface of the cleaning pad faces the surface to be cleaned; and a second use position in which the second cleaning surface of the cleaning pad faces the surface to be cleaned;

wherein the foot assembly is further swivelable relative to the steam distributor about the first axis of rotation.

2. The surface cleaning apparatus of claim 1, wherein the coupling joint further defines a second axis of rotation about which the foot assembly is rotatable relative to the handle assembly.

3. The surface cleaning apparatus of claim 1, wherein the base housing comprises a slot extending inwardly from a peripheral side thereof and receives a portion of the coupling joint.

4. The surface cleaning apparatus of claim 3, and wherein the cleaning pad comprises corresponding slots in the first and second cleaning surfaces to allow the coupling joint to extend exteriorly out of the cleaning pad.

5. The surface cleaning apparatus of claim 3, wherein the first axis of rotation is generally perpendicular to a direction of travel of the surface cleaning apparatus, and the peripheral side of the base housing comprising the slot defines a rear side of the base housing in the first use position and the peripheral side of the base housing comprising the slot defines a front side of the base housing in the second use position.

6. The surface cleaning apparatus of claim 1, wherein the steam distributor comprises a manifold.

7. The surface cleaning apparatus of claim 6, wherein the manifold comprises an elongated tube extending along the first axis of rotation.

8. The surface cleaning apparatus of claim 7, wherein the foot assembly is further swivelable around the manifold.

9. The surface cleaning apparatus of claim 6, wherein the manifold comprises a plurality of release openings for delivering cleaning fluid to the surface to be cleaned.

10. The surface cleaning apparatus of claim 6, wherein the manifold comprises a tube with at least one release opening in the tube.

11. The surface cleaning apparatus of claim 10, wherein the foot assembly comprises a pivot cradle which receives the manifold, and the pivot cradle comprises multiple steam distribution openings formed therein.

12. The surface cleaning apparatus of claim 11, wherein the at least one release opening is in fluid communication with a first one of the multiple steam distribution openings in the first use position and the at least one release opening is in fluid communication with a second one of the multiple steam distribution openings in the second use position.

13. The surface cleaning apparatus of claim 1, wherein the coupling joint comprises:

a foot connector coupled with the base housing; and a handle connector pivotally coupled with the foot connector;

wherein the foot connector comprises a pivot receiver which receives the steam distributor and defines the first axis of rotation.

14. The surface cleaning apparatus of claim 1, wherein the steam distributor is generally oriented toward the surface to be cleaned in both the first and second use positions.

15. The surface cleaning apparatus of claim 1, wherein the steam distributor comprises at least one release opening generally facing the surface to be cleaned in both the first and second use positions.

16. The surface cleaning apparatus of claim 1 and further comprising a latch assembly configured for selective detachment of the foot assembly from the handle assembly.

17. The surface cleaning apparatus of claim 1 and further comprising a fluid conduit fluidly coupled with the steam distributor and passing through the coupling joint.

18. The surface cleaning apparatus of claim 1, wherein the base housing comprises first and second enclosures, wherein the steam distributor is mounted between the first and second enclosures.

19. The surface cleaning apparatus of claim 1, wherein the steam distributor is provided at a lower end of the handle assembly.

20. The surface cleaning apparatus of claim 1 and further comprising a biasing mechanism associated with the base housing, wherein the biasing mechanism provides a directing force to at least one of the base housing or the coupling joint with respect to the handle assembly to direct the base housing away from the first and second use positions when the base housing is lifted from the surface to be cleaned.

* * * * *